US009293840B2

(12) United States Patent
Wasai et al.

(10) Patent No.: US 9,293,840 B2
(45) Date of Patent: Mar. 22, 2016

(54) WIRE CONNECTOR HAVING A WIRE HOLDER WITH AN ABUTTING PORTION AND A PROTECTING PORTION

(71) Applicant: 3M INNOVATIVE PROPERTIES COMPANY, St. Paul, MN (US)

(72) Inventors: Kenta Wasai, Sagamihara (JP); Rentaro Ohsawa, Tokyo (JP); Tomoyasu Oike, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/409,747

(22) PCT Filed: Mar. 7, 2013

(86) PCT No.: PCT/US2013/029495

§ 371 (c)(1),
(2) Date: Dec. 19, 2014

(87) PCT Pub. No.: WO2014/011219

PCT Pub. Date: Jan. 16, 2014

(65) Prior Publication Data

US 2015/0194743 A1 Jul. 9, 2015

(30) Foreign Application Priority Data

Jul. 13, 2012 (JP) ..... 2012-157863

(51) Int. Cl.

| | |
|---|---|
| ***H01R 4/24*** | (2006.01) |
| ***H01R 13/518*** | (2006.01) |
| *H01R 11/09* | (2006.01) |

(52) U.S. Cl.

CPC ..... *H01R 4/2433* (2013.01); *H01R 4/245* (2013.01); *H01R 4/2429* (2013.01); *H01R 4/2445* (2013.01); *H01R 13/518* (2013.01); *H01R 11/09* (2013.01)

(58) Field of Classification Search

CPC .... H01R 14/24; H01R 4/2433; H01R 4/2445; H01R 13/516; H01R 13/518

USPC ..... 439/391, 400, 402, 405

See application file for complete search history.

(56) References Cited

U.S. PATENT DOCUMENTS 5,934,930 A * 8/1999 Camps ..... H01R 4/2404 439/402
6,017,241 A * 1/2000 Komai ..... H01R 4/2404 439/409

(Continued)

FOREIGN PATENT DOCUMENTS

JP H6-251824 9/1994
JP 2002-151169 5/2002

OTHER PUBLICATIONS

International Search report for PCT International Application No. PCT/US2013/029495, mailed on Jun. 27, 2013, 3 pages.

*Primary Examiner* — Chandrika Prasad
(74) *Attorney, Agent, or Firm* — Janet Kling

(57) ABSTRACT

A wire connector is described that suppresses the cutting of wires accidentally. The wire connector 1 includes a wire holder 6 that holds at least two wires, a contact 7A that electrically connects the two wires and a body 4 that holds the wire holder. The wire holder 6 includes first and second end faces 24 and 26, and a wire holding portion 25 that includes first and second holding portions 32, 33, 34 and 36. On the first end face 24, at portions of circumferential edge portions of the openings 34*c* and 36*d* of the second holding portions 34 and 36, protecting portions 23 that project from the first end face 24 and protect the wires are provided.

8 Claims, 17 Drawing Sheets

(56) References Cited

U.S. PATENT DOCUMENTS 6,406,323 B2 * 6/2002 Chung Long Shan ..... H01R 4/2416 439/395
6,552,268 B2 * 4/2003 Daoud ..... H01R 4/2433 174/59
7,267,571 B1 * 9/2007 Twigg ..... H01R 4/2433 439/402
7,416,434 B2 * 8/2008 Saha ..... H01R 13/501 439/402
7,867,013 B2 1/2011 Cox
2004/0229495 A1 * 11/2004 Negishi ..... H01R 4/2433 439/402
2005/0227529 A1 10/2005 Mrakovich
2008/0085625 A1 * 4/2008 Saha ..... H01R 13/501 439/402
2009/0098761 A1 4/2009 Motohira

* cited by examiner

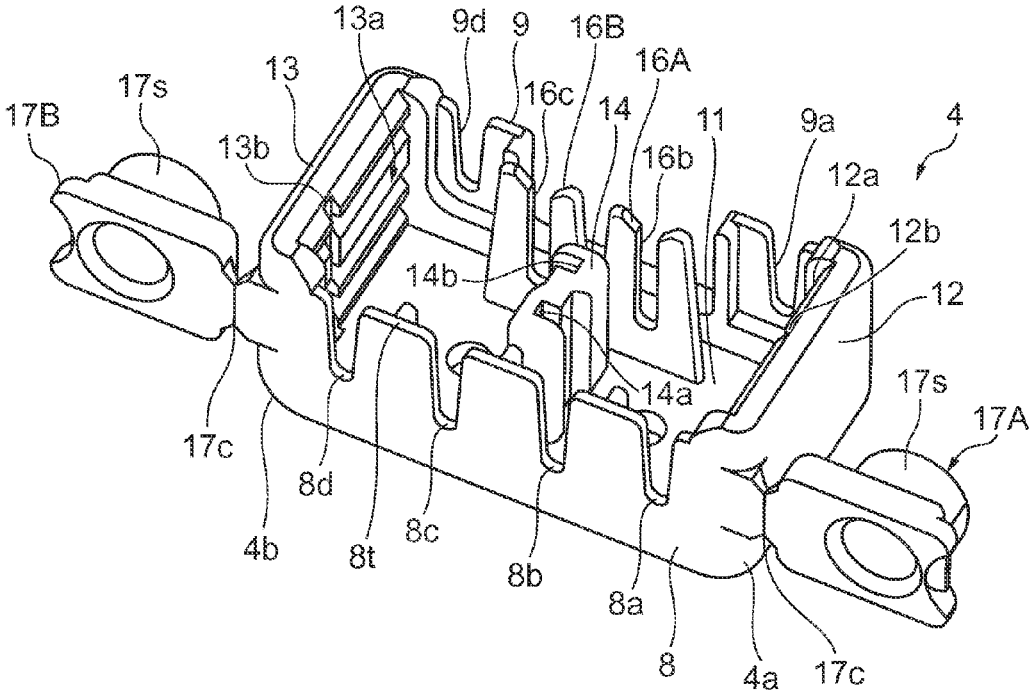
FIG. 2
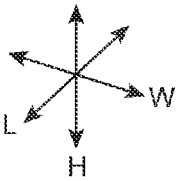

WIRE CONNECTOR HAVING A WIRE HOLDER WITH AN ABUTTING PORTION AND A PROTECTING PORTION

FIELD OF INVENTION

This invention relates to a wire connector.

BACKGROUND ART

Modes for connecting a plurality of wires include, for example, a mode of connecting a main wire to branch wires in order to allow branching of a signal or the like, and a mode of connecting a wire to another wire to increase wire length.

An example of the former mode is a connector described in Japanese Unexamined Patent Application Publication No. 2002-151169. A branch connector includes: a connector body for holding a trunk-use twisted pair cable and a branch-use twisted pair cable; a pair of crimp terminals disposed in the connector body for electrically connecting the trunk-use twisted pair cable to the branch-use twisted pair cable; and a lid body fixed to the connector body. Provided at a first end of the crimp terminals are a crimping edge to which a portion partway along the trunk-use twisted pair cable is connected. Provided at a second end of the crimp terminals are a crimping edge to which an end portion of the branch-use twisted pair cable is connected. With such a configuration, the trunk-use twisted pair cable can be branched into the branch-use twisted pair cable without peeling off a cover material of the trunk-use twisted pair cable or the branch-use twisted pair cable to expose core wires.

An example of the latter mode is a communication cable connector described in Japanese Unexamined Patent Application Publication No. H6-251824. The communication cable connector includes a connector body, and a cover disposed in the connector body for holding the communication cable. The connector body includes a crimp terminal electrically connected to a communication cable, and a male contact and a female contact coupled to the crimp terminal. According to this configuration, the male contact of a first cable connector is connected to the female contact of a second cable connector by bringing together and engaging the first cable connector and the second cable connector. Hence, the communication cable held by the first cable connector can be connected to the communication cable held by the second cable connector, and thereby extended.

SUMMARY OF THE INVENTION

The conventional connectors were intended either for wire branching or for wire extension. With such connectors, it was necessary to prepare a plurality of types of connectors to support the different connection modes of the wires. Further, in operations using connectors capable of supporting either wire branching or wire extension, a wire cutting operation was sometimes necessary after electrically connecting the wires.

Thus, it is an object of the present invention to provide a wire connector capable of supporting both wire branching and wire extension, and to suppress cutting of wires by mistake in the wire cutting operation.

A first aspect of the present invention is a wire connector including: a wire holder holding at least a first wire and a second wire; a contact electrically connecting the first wire and the second wire; and a body fixing the contact and holding the wire holder, wherein the wire holder includes: a first end face formed at a first end side in a predetermined direction; a second end face formed at a second end side in the predetermined direction; and a first wire holding portion holding the first wire and the second wire in a state of the first wire and the second wire extending in the predetermined direction and being mutually adjacent in a direction orthogonal to the predetermined direction, the first wire holding portion includes a first holding portion that holds the first wire; a second holding portion formed at a position separated from the first holding portion in the direction orthogonal to the predetermined direction and holding the second wire, in the first holding portion, an opening enabling the first wire to be pulled through is formed in the first end face and the second end face, in the second holding portion, an opening enabling the second wire to be pulled through is formed in the first end face and an abutting portion for abutting an end portion of the second wire is formed on the second end face side, on the first end face, in at least a portion of a circumferential edge of the opening in the second holding portion, a protecting portion that projects from the first end face and protects the second wire is provided.

In the wire connector, the first wire can be pulled through the openings formed in the first and second end faces in the first holding portion. Hence, the first holding portion can hold the first wire which is the main wire. In the second holding portion, a first end of the second wire abuts with the second end face side. Also, the second wire is pulled through the opening formed in the first end face. Hence, the second holding portion can hold the second wire that is either a branching wire for branching the main wire or an extension wire for extending the main wire. According to this configuration, when the first wire pulled through the opening of the first holding portion is not cut, the first wire can be branched into the first wire and the second wire. On the other hand, when the first wire is cut, the first wire can be extended through a connection with the second wire. Moreover, the second wire, which is arranged so as to be adjacent to the first wire, is protected by the protecting portion provided around at least a portion of the circumferential edge of the opening in the second holding portion on the first end face. Accordingly, cutting of the second wire by mistake in cutting operations on the first wire can be suppressed.

In another aspect, the protecting portion has a cylindrical form that surrounds the second wire and includes a wire through hole that communicates with the second holding portion and through which the second wire is inserted. Hence, the protecting portion is formed around an entire circumference of the second wire that is pulled through the opening formed in the first end face. Accordingly, the cutting of the second wire by mistake in cutting operations on the first wire can be further suppressed.

In another aspect, the wire holder further includes a second wire holding portion that is not the first wire holding portion, and the second holding portion of the first wire holding portion and a second holding portion of the second wire holding portion are disposed between the first holding portion of the first wire holding portion and the first holding portion of the second wire holding portion. Hence, a wire pair formed by two pairs of first and second wires can be branched or extended using a single wire connector.

In another aspect, the body includes a cover that covers the opening of the first holding portion. Hence, the end face of the first wire that has been cut can be protected.

According to the present invention, a wire connector is capable of supporting both wire branching and wire extension, and able to suppress the cutting of wires by mistake in the wire cutting operation.

BRIEF DESCRIPTION OF DRAWINGS

FIG. 2 is a perspective view illustrating a body of the wire connector according FIG. 1.

DETAILED DESCRIPTION OF THE INVENTION

Figure 11:
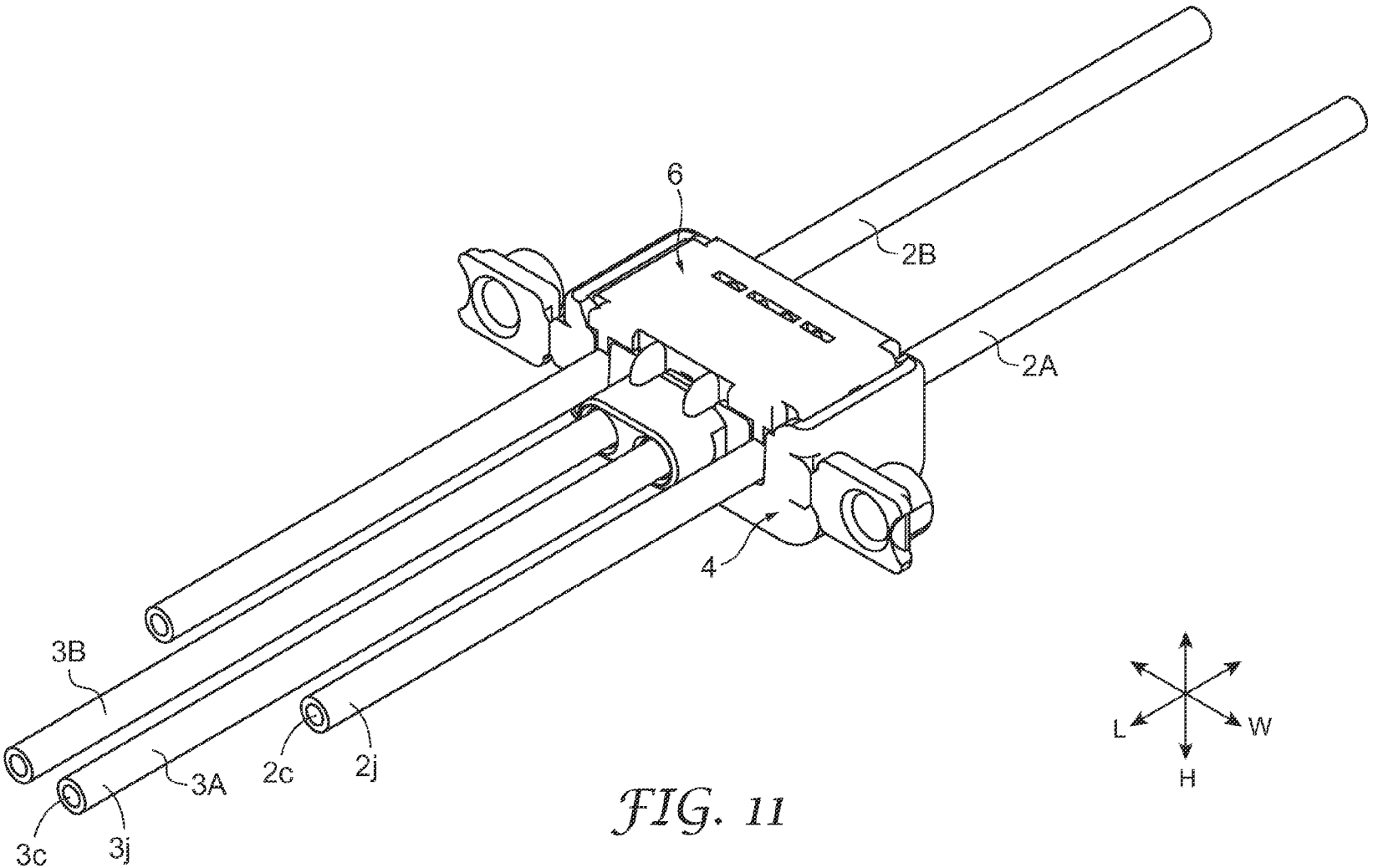
FIG. 11 is a diagram for describing a method for extending the main wire using the wire connector.

An embodiment of the present invention is described below in detail while referring to the accompanying drawings. In the explanations of the drawings, duplicate explanations of the same element with the same reference numeral are omitted. Note that in the following embodiments, a case in which an extension wire is connected to a main wire in order to extend the main wire is taken as an example. Note that, as illustrated in FIG. 11, the wire connector according to this embodiment may also be used to branch the main wire into a main wire and an extension wire.

Figure 1:
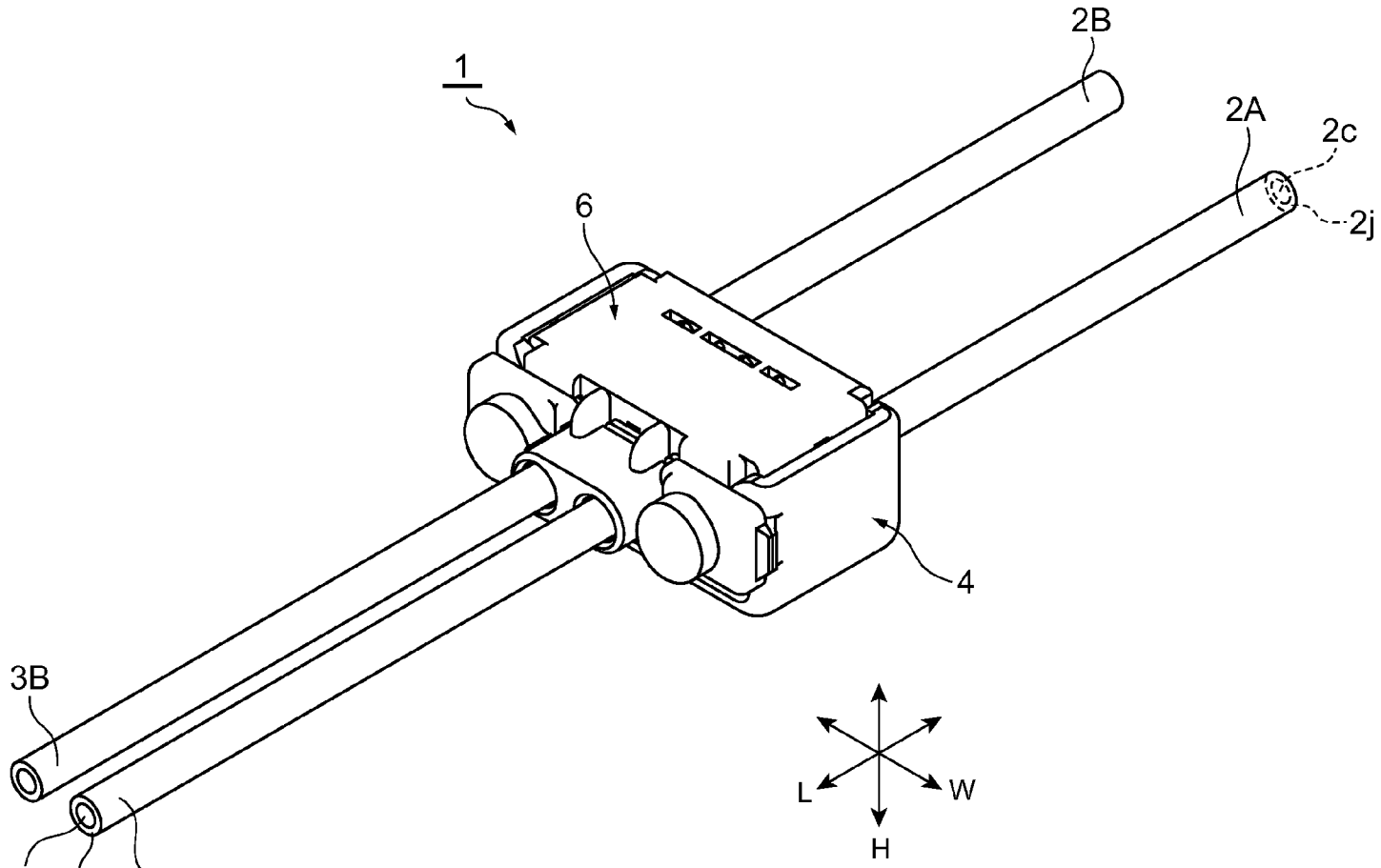
FIG. 1 is a perspective view illustrating a wire connector according to an embodiment.

FIG. 1 is a perspective view illustrating a wire connector 1 according to this embodiment, illustrating a form of connecting main wires (first wires) 2A and 2B to extension wires (second wires) 3A and 3B. As illustrated in FIG. 1, the wire connector 1 electrically connects the main wire 2A to the extension wire 3A and the main wire 2B to the extension wire 3B. Note that in this embodiment, the term "wire" is used to mean an electrical wire covered by a member formed from an insulating material. The main wires 2A and 2B and the extension wires 3A and 3B have, for example, a diameter of from 0.3 mm to 0.9 mm. The wire connector 1 has a substantially rectangular box-like form. The wire connector 1 connects wires in a state such that the wires 2A, 2B, 3A and 3B extend in a short-side direction, and are arranged in a row in a long-side direction. Note that for the sake of convenience in the following description, the short-side direction of the wire connector 1 is denoted as a predetermined direction L, and the long-side direction of the wire connector 1 is denoted as a width direction W. A direction orthogonal to both the short-side direction and the long-side direction is denoted as a thickness direction H. Accordingly, the main wires 2A and 2B and the extension wires 3A and 3B being connected using the wire connector 1 extend in the predetermined direction L, and are arranged in a row along the width direction W.

The wire connector 1 includes a body 4, and a wire holder 6 that holds the main wires 2A and 2B and the extension wires 3A and 3B. Further, the wire connector 1 includes a contact 7A (FIG. 3) that electrically connects the main wire 2A to the extension wire 3A and a contact 7B that electrically connects the main wire 2B to the extension wire 3B (see FIG. 7).

FIG. 2 is a perspective view illustrating the body 4. The body 4 is a box-like member having a rectangular parallelepiped form. The body 4 is formed from a material with insulating properties, such as a resin. The body 4 includes a front wall portion 8 formed on a first end side in the predetermined direction L and a back wall portion 9 formed on a second end side in the predetermined direction L. The front wall portion 8 and the back wall portion 9 oppose each other separated in the predetermined direction L, and are both orthogonal to the predetermined direction L. Further, the body 4 has a bottom portion 11 and sidewalls 12 and 13 extending between the front wall portion 8 and the back wall portion 9. The wire holder 6 is disposed in a space enclosed by the front wall portion 8, the back wall portion 9, the bottom portion 11 and the sidewalls 12 and 13.

The front wall portion 8 has four grooves 8*a* to 8*d* formed therein, the grooves functioning as guides for determining positions in the width direction W of the main wires 2A and 2B and the extension wires 3A and 3B. The groove 8*a* adjacent to the sidewall 12 functions as a guide for determining a position in the width direction W of the main wire 2A. The groove 8*b* adjacent to the groove 8*a* functions as a guide for determining a position in the width direction W of the extension wire 3A. The groove 8*c* adjacent to the groove 8*b* functions as a guide for determining a position in the width direction W of the extension wire 3B. The groove 8*d* adjacent to the sidewall 13 functions as a guide for determining a position in the width direction W of the main wire 2B. The grooves 8*a* to 8*d* are grooves that open to a top edge 8*t* of the front wall portion 8 and have a substantially U-shaped profile extending from the top edge 8*t* to a position partway toward the bottom portion 11. The width of the grooves 8*a* to 8*d* is substantially equal to or greater than the diameter of jackets 2*j* and 3*j* (FIG. 1) of the main wires 2A and 2B or the extension wires 3A and 3B. The width of the grooves 8*a* to 8*d* gradually reduces from the top edge 8*t* to the bottom portion 11.

The back wall portion 9 has two grooves 9*a* and 9*d* formed therein, the grooves functioning as guides for determining positions in the width direction W of the main wires 2A and 2B. The groove 9*a* is formed at a position that opposes the groove 8*a* of the front wall portion 8. The groove 9*d* is formed at a position that opposes the groove 8*d* of the front wall portion 8. Accordingly, the groove 9*a* determines a position in the width direction W of the main wire 2A, and the groove 9*d* determines a position in the width direction W of the main wire 2B. The grooves 9*a* and 9*d* have the same form as the groove 8*a* and the like.

On the inner side of the sidewalls 12 and 13, a plurality of protruding portions 12*a* and 13*a* for fixing the wire holder 6 to the body 4 is formed. The protruding portions 12*a* and 13*a* project from the sidewalls 12 and 13 toward the inside of the body 4 and extend from the front wall portion 8 to the back wall portion 9. A groove 12*b* extending in the thickness direction H is formed in the protruding portion 12*a* of the sidewall 12. An end portion of the groove 12*b* reaches the bottom portion 11. A groove 13*b* extending in the thickness direction H is formed in the protruding portion 13*a* of the sidewall 13. An end portion of the groove 13*b* reaches the bottom portion 11.

On the bottom portion 11, an upward projecting portion 14 for holding contacts 7A and 7B is formed. The upward projecting portion 14 projects from the bottom portion 11. The upward projecting portion 14 is provided in a central position in the width direction W of the bottom portion 11. The upward projecting portion 14 extends in the predetermined direction L so as to include a side face opposing the sidewall 12 and a side face opposing the sidewall 13. The front wall portion 8 and the upward projecting portion 14 are not connected, but separated by a gap. The back wall portion 9 and the upward projecting portion 14 are not connected, but separated by a gap. The upward projecting portion 14 reaches the same height in the thickness direction H as the front wall portion 8, the back wall portion 9 and the sidewalls 12 and 13. A groove 14*a* for holding the contact 7A is formed in the side face of the upward projecting portion 14 opposing the sidewall 12. A groove 14*b* for holding the contact 7B is formed in the side face of the upward projecting portion 14 opposing the sidewall 13. The grooves 14*a* and 14*b* extend from the tip ends of the upward projecting portion 14 to the bottom portion 11.

The bottom portion 11 has upward projecting portions 16A and 16B formed projecting therefrom, the upward projecting portions 16A and 16B functioning as guides for determining positions in the width direction W of the extension wires 3A and 3B. The upward projecting portions 16A and 16B are formed between the upward projecting portion 14 and the back wall portion 9, on both sides of the center line of the body 4 in the width direction W. The upward projecting portions 16A and 16B reach the same height in the thickness direction H as the front wall portion 8, the back wall portion 9 and the sidewalls 12 and 13. In the upward projecting portion 16A, a U-shaped groove 16*b* is formed for determining a position in the width direction W of the extension wire 3A. In the upward projecting portion 16B, a U-shaped groove 16*c* is formed for determining a position in the width direction W of the extension wire 3B. The groove 16*b* is formed at a position that opposes the groove 8*b* of the front wall portion 8. The groove 16*c* is formed at a position that opposes the groove 8*c* of the front wall portion 8. Accordingly, the groove 16*b* serves to determine the position in the width direction W of the extension wire 3A, and the groove 16*c* serves to determine the position in the width direction W of the extension wire 3B. The grooves 16*b* and 16*c* have the same form as the groove 8*a* and the like.

At a corner portion 4*a* formed by the front wall portion 8 and the sidewall 12, a cover 17A is formed for protecting an end portion of the main wire 2A. At a corner portion 4*b* formed by the front wall portion 8 and the sidewall 13, a cover 17B is formed for protecting an end portion of the main wire 2B. The covers 17A and 17B each include a cover portion 17*s* that covers end portions of the main wires 2A and 2B, and a coupling portion 17*c* that couples the cover portion 17*s* to the body 4. The covers 17A and 17B can be moved to the front wall portion 8 side by bending the coupling portions 17*c*.

Figure 3:
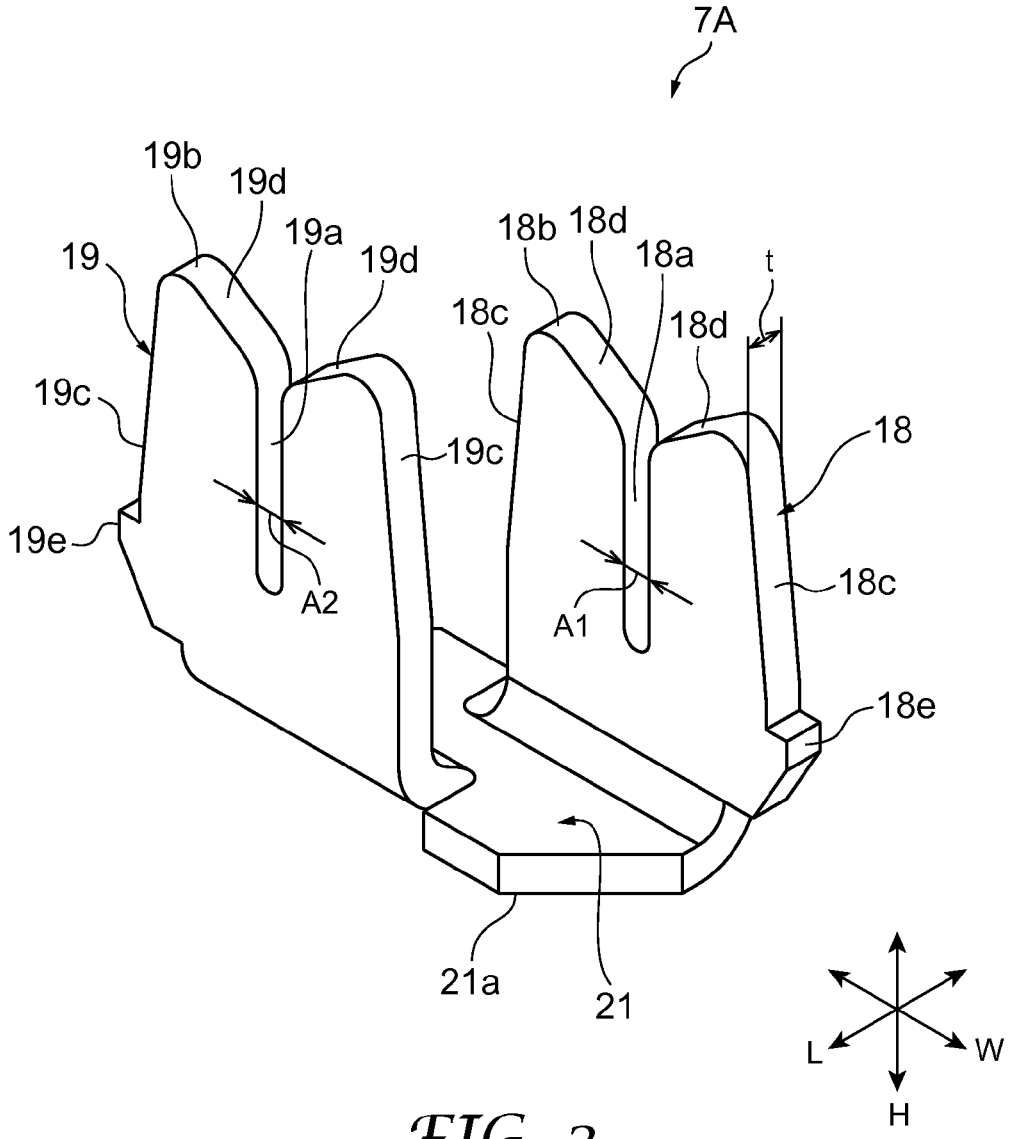
FIG. 3 is a perspective view illustrating a contact of the wire connector according FIG. 1.

FIG. 3 is a perspective view illustrating the contact 7A. The contact 7A electrically connects the main wire 2A to the extension wire 3A by penetrating into a jacket 2*j* of the main wire 2A and making contact with a conducting wire 2*c* (FIG. 1), and penetrating into a jacket 3*j* of the extension wire 3A and making contact with a conducting wire 3*c*. The contact 7A mechanically holds the main wire 2A by sandwiching the conducting wire 2*c*, and mechanically holds the extension wire 3A by sandwiching the conducting wire 3*c*. The contact 7B has the same configuration as the contact 7A, and so further detailed descriptions have been omitted.

As illustrated in FIG. 3, the contact 7A is a plate-like member bent to form into a U-shape when viewed along the width direction W, and includes a first sandwiching portion 18 that sandwiches the main wire 2A in the width direction W, a second sandwiching portion 19 that sandwiches the extension wire 3A in the width direction W, and a base portion 21 that connects the first sandwiching portion 18 and the second sandwiching portion 19 separated in the predetermined direction L. The contact 7A is configured from an electrically conductive material such as iron, aluminum, copper or the like.

In the first sandwiching portion 18, a groove 18*a* for sandwiching the main wire 2A in the width direction W is formed. The groove 18*a* is formed in a central position of the first sandwiching portion 18 in the width direction W, and extends from an end portion 18*b* toward the base portion 21. A width A1 of the groove 18*a* is set to be substantially equal to or slightly less than the diameter of the conducting wire 2*c* of the main wire 2A. By setting the width A1 of the groove 18*a* as described above, the first sandwiching portion 18 can be caused to reliably contact the conducting wire 2*c* of the main wire 2A, and conduction can thus be reliably secured.

At the end portion 18*b* of the first sandwiching portion 18, an inclined face 18*d* extends with a downward inclination from a side face 18*c* toward the groove 18*a*. The inclined face 18*d* makes it easier to insert the main wire 2A into the groove 18*a*.

In the first sandwiching portion 18, a protruding portion 18*e* is formed. The protruding portion 18*e* is formed on the base portion 21 side of the side face 18*c* outside of the first sandwiching portion 18. The protruding portion 18*e* is guided by the groove 12*b* in the sidewall 12 of the body 4. The protruding portion 18*e* and the groove 12*b* allow the contact 7A to be easily positioned and disposed inside the body 4.

In the second sandwiching portion 19, a groove 19*a* for sandwiching the extension wire 3A in the width direction W is formed. The groove 19*a* is formed in a central position of the second sandwiching portion 19 in the width direction W, and extends from an end portion 19*b* toward the base portion 21. A width A2 of the groove 19*a* is set to be substantially equal to or slightly less than the diameter of the conducting wire 3*c* of the extension wire 3A. At the end portion 19*b* of the second sandwiching portion 19, an inclined face 19*d* extends with a downward inclination from a side face 19*c* toward the groove 19*a*. In the second sandwiching portion 19, a protruding portion 19*e* is formed. The protruding portion 19*e* is formed on the base portion 21 side of the side face 19*c* of the second sandwiching portion 19, protruding in the opposite direction to the protruding portion 18*e*. The protruding portion 19*e* is guided by the groove 14*a* in the upward projecting portion 14 of the body 4. The protruding portion 19*e* and the groove 14*a* allow the contact 7A to be easily positioned and disposed inside the body 4.

The base portion 21 connects the first sandwiching portion 18 and the second sandwiching portion 19 to each other separated in the predetermined direction L. In other words, the first sandwiching portion 18 and the second sandwiching portion 19 are electrically connected to each other via the base portion 21. When the contact 7A is disposed in the body 4, a back face 21*a* of the base portion 21 abuts with the bottom portion 11 of the body 4.

The contact 7A has a thickness t that allows cutting of the jackets 2*j* and 3*j* so that the contact 7A contacts the conducting wire 2*c* of the main wire 2A and the conducting wire 3*c* of the extension wire 3A. For example, the thickness t is approximately from 0.3 mm to 0.7 mm. The contact 7A having such a thickness t can easily penetrate into the jacket 2*j* of the main wire 2A and the jacket 3*j* of the extension wire 3A. Hence, disconnection of the conducting wires 2*c* and 3*c* due to deformation can be suppressed.

Note that the thickness t of the contact 7A is not necessarily uniform. For example, a knife-like form may be used with the thickness t of the first sandwiching portion 18 becoming thinner toward the groove 18*a*. Since the contact 7A having such a form has a thin thickness t in the first sandwiching portion 18 in proximity to the groove 18*a*, the jacket 2*j* of the main wire 2A can be easily penetrated. Other parts of the first sandwiching portion 18 can be thick, stiffness can be ensured.

Figure 4:
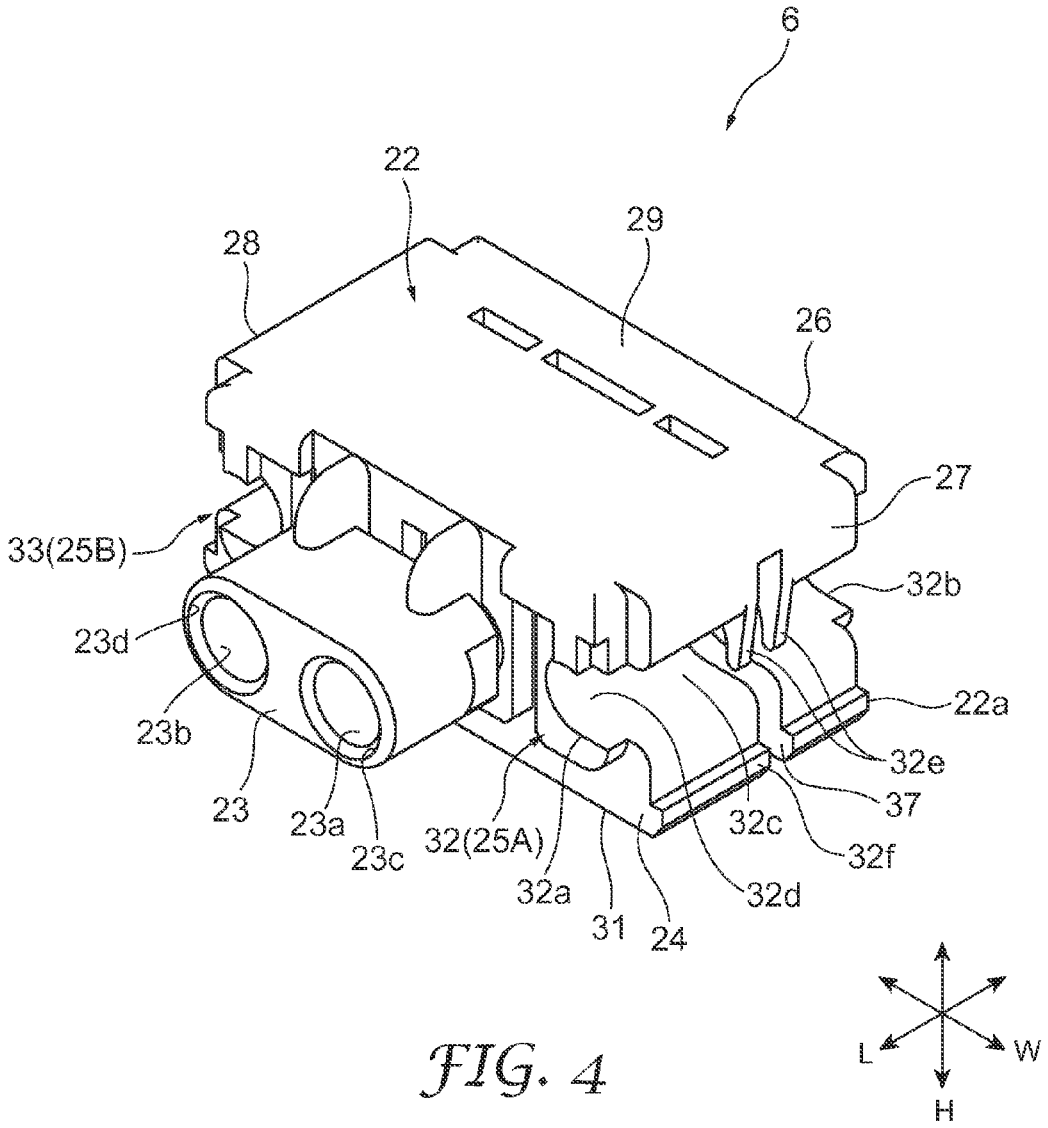
FIG. 4 is a perspective view illustrating a view of wire holder of the wire connector according FIG. 1 as seen from above.
Figure 5:
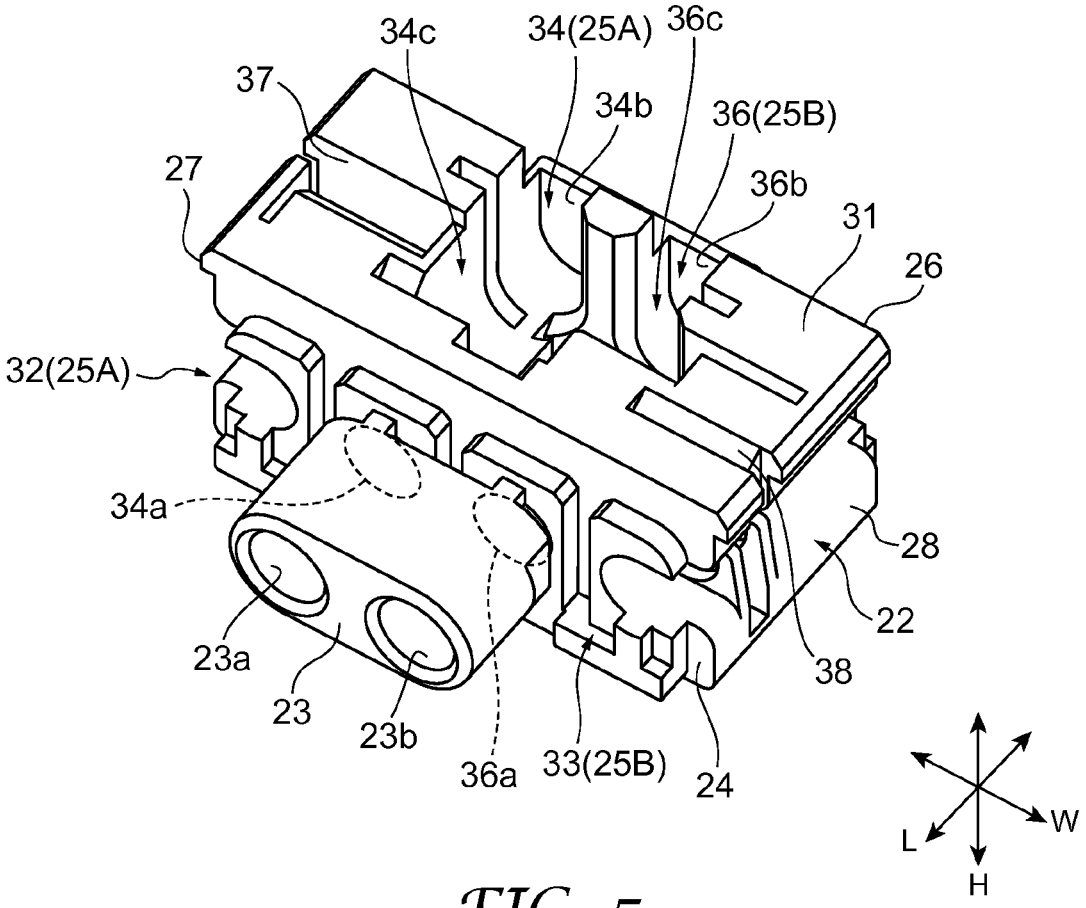
FIG. 5 is a perspective view illustrating a view of the wire holder of the wire connector according FIG. 1 as seen from below.

FIG. 4 is a perspective view illustrating the wire holder 6 seen from above. FIG. 5 is a perspective view illustrating the wire holder 6 seen from below. The wire holder 6 holds the wires in a state such that the wires 2A, 2B, 3A and 3B extend in the predetermined direction L, and are arranged in a row in the width direction W. More specifically, the wires are disposed along the width direction W in the following order: the main wire 2A, the extension wire 3A connected to the main wire 2A, the main wire 2B, and the extension wire 3B connected to the main wire 2B as shown in FIG. 1. In other words, the wire holder 6 holds the wires so that the extension wires 3A and 3B disposed to be adjacent to each other are sandwiched by the main wires 2A and 2B.

The wire holder 6 includes a rectangular parallelepiped body portion 22 and a sheath-like protecting portion 23 provided in the body portion 22. The body portion 22 includes a first end face 24 formed on a first end side of the predetermined direction L, a second end face 26 formed on a second end side of the predetermined direction L, side faces 27 and 28 extending between the first end face 24 and the second end face 26, a top face 29 and a bottom portion 31. Note that the first end face 24 is not necessarily flat and may include recesses and protrusions. Also, the second end face 26 is not necessarily flat and may include recesses and protrusions. The body portion 22 also includes a first wire holding portion 25A having a first holding portion 32 for holding the main wire 2A and a second holding portion 34 for holding the extension wire 3A. The body portion 22 further includes a second wire holding portion 25B having a first holding portion 33 for holding the main wire 2B and a second holding portion 36 for holding the extension wire 3B.

The first holding portion 32 for holding the main wire 2A is formed on a side face 27 side of the body portion 22. The first holding portion 32 has a recess portion 32*d* formed therein, partitioned and formed by an opening 32*a* formed in the first end face 24, an opening 32*b* formed in the second end face 26, and an opening 32*c* formed in the side face 27. The openings 32*a* and 32*b* are set to be greater than a cross-section of the main wire 2A. Hence, a first end side of the main wire 2A can be pulled through either the opening 32*a* or the opening 32*b* to the outside of the wire holder 6, and a second end side of the main wire 2A can be pulled through the other of the opening 32*a* and the opening 32*b* to the outside of the wire holder 6. Hence, the main wire 2A can be pulled through the arrangement using the openings 32*a* and 32*b*.

In the first holding portion 32, hook pieces 32*e* for preventing the main wire 2A from falling out are provided. The hook pieces 32*e* are formed across the opening 32*c* formed in the side face 27 in the thickness direction H. At a corner portion 22*a* formed by the side face 27 and the bottom portion 31 of the body portion 22, a protruding portion 32*f* projecting in the width direction W from the side face 27 is formed. The protruding portion 32*f* is engaged with the protruding portion 12*a* provided on the sidewall 12 of the body 4 to fix the wire holder 6 to the body 4.

The first holding portion 33 for holding the main wire 2B is formed on the side face 28 side of the body portion 22, opposing the side face 27. The first holding portion 33 has a similar configuration to the first holding portion 32 formed in the side face 27.

As illustrated in FIG. 5, the second holding portions 34 and 36 are formed between the first holding portion 32 and the first holding portion 33. The second holding portions 34 and 36 have formed therein two openings 34*a* and 36*a* formed in the first end face 24, and two abutting portions 34*b* and 36*b* formed on the second end face 26 side. The openings 34*a* and 36*a* are formed in the same way as the opening 32*a* in the first holding portion 32. Hence, a first end side of the extension wires 3A and 3B can be inserted into the wire holder 6 via the openings 34*a* and 36*a*. The extension wires 3A and 3B can thus be pulled through the openings 34*a* and 36*a*.

The second holding portions 34 and 36 have formed therein two recess portions 34*c* and 36*c* partitioned and formed between the openings 34*a* and 36*a* and the abutting portions 34*b* and 36*b*, opening to the bottom portion 31 of the body portion 22. Further, in the bottom portion 31 of the body portion 22, a groove 37 for insertion of the contact 7A and a groove 38 for insertion of the contact 7B are formed. The groove 37 has a width slightly greater than the thickness t of the contact 7A and extends from the bottom portion 31 side toward the top face 29 side. Further, a portion of the grooves 37 and 38 open to the top face 29 (see FIG. 4).

Figure 6:
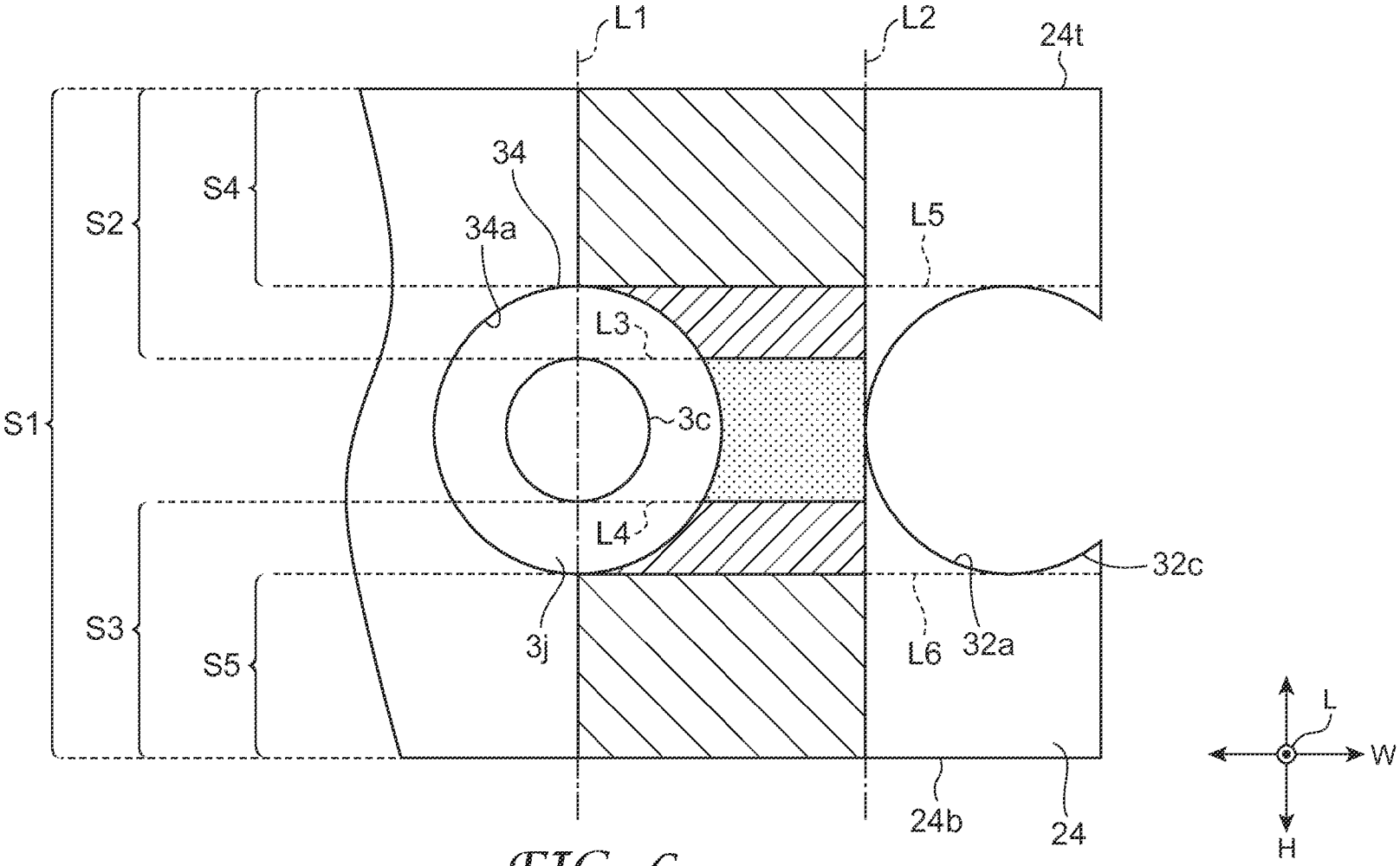
FIG. 6 is a diagram for explaining a position where a protecting portion is formed.

Next, the protecting portion 23 is described. FIG. 6 is a view for describing a position at which the protecting portion 23 protects the extension wires 3A and 3B. FIG. 6 is a view of the first end face of the wire holder 6 seen along the predetermined direction L, and illustrates the opening 32*a* of the first holding portion 32 and the opening 34*a* of the second holding portion 34. To protect the extension wire 3A from being mistakenly cut with nippers or the like, at a peripheral edge portion of the opening 34*a* of the second holding portion 34, a portion of the protrusions is formed to constitute the protecting portion 23 in a region S1 between a center line L1 of the opening 34*a* in the thickness direction H and a tangent line L2 on the second holding portion 34 side along the thickness direction H of the first holding portion 32. A width of the region S1 is prescribed by the center line L1 in the thickness direction H of the opening 34*a* and the tangent line L2 on the second holding portion 34 side along the thickness direction H of the first holding portion 32. A height of the region S1 is prescribed by a top edge 24*t* and a bottom edge 24*b* of the first end face 24.

It is preferable that the protecting portion 23 is formed, in the region S1, in at least one of a region S2 between a tangent line L3 in the width direction W of the conducting wire 3*c* and the top edge 24*t* of the first end face 24 and a region S3 between a tangent line L4 in the width direction W of the conducting wire 3*c* and the bottom edge 24*b* of the first end face 24. As a result of the protrusions formed in the regions S2 and S3, blades of the nippers will contact the protrusions before reaching the conducting wire 3*c*.

It is further preferable that the protecting portion 23 is formed in at least one of a region S4 between a tangent line L5 in the width direction W of the opening 34*a* and the top edge 24*t* in the region S2, and a region S5 between a tangent line L6 in the width direction W of the opening 34*a* and the bottom edge 24*b* in the region S3. As a result of the protrusions formed in the regions S4 and S5, blades of the nippers will contact the protrusions before reaching the jacket 3*j* of the extension wires 3A and 3B.

As a result of the protecting portion 23 including the protrusions formed in the regions S1 to S5, when the nippers (not illustrated) are inserted from the main wire 2A side, the blades of the nippers contact the protecting portion 23. Even if the blades of the nippers do not contact the protecting portion 23 when inserted, the blades of the nippers will contact the protecting portion 23 when the blades of the nippers are closed. When the blades of the nippers contact the protecting portion 23, the operator will feel a resistance that differs from that when cutting only the main wire 2A. Hence, the operator can recognize when the nippers are at a position to cut the extension wire 3A.

As illustrated in FIG. 4 and FIG. 5, in the wire connector 1 of this embodiment, the protecting portion 23 is formed in the first end face 24 of the body portion 22. The protecting portion 23 prevents the extension wires 3A and 3B being mistakenly cut with the main wires 2A and 2B when the main wires 2A and 2B are being cut. The protecting portion 23 includes portions formed in the regions S1 to S5 that constitute a portion of the peripheral edge portions of the openings 34*a* and 36*a* in the second holding portions 34 and 36. The protecting portion 23 forms a cylinder-like shape surrounding the extension wires 3A and 3B, and protrudes in the predetermined direction L from the first end face 24. A length along the predetermined direction L of the protecting portion 23 should, for example, be at least 2 mm with no particular upper limit. However, the length may be 10 mm or less. The length along the predetermined direction L of the protecting portion 23 is preferably not less than 4 mm and not more than 5 mm.

A wire through hole 23*a* is formed in the protecting portion 23. The wire through hole 23*a* is formed further to the first holding portion 32 side than the center of the protecting portion 23 in the width direction W. The wire through hole 23*a* pierces in the predetermined direction L and has an inside diameter that is substantially equal to or slightly greater than the diameter of the extension wire 3A. The wire through hole 23*a* is formed at a position opposing the opening 34*a* of the second holding portion 34. The central axis of the opening 34*a* overlaps the central axis of the wire through hole 23*a*, and the wire through hole 23*a* communicates with the second holding portion 34. The extension wire 3A inserted into the through hole 23*d* is pulled into the second holding portion 34. Accordingly, the extension wire 3A pulled through the opening 34*a* is covered around an entire circumference by the protecting portion 23 over, for example, a range of 4 mm to 5 mm from the opening 34*a* in the predetermined direction L.

A wire through hole 23*b*, which is not the wire through hole 23*a*, is formed in the protecting portion 23. The wire through hole 23*b* is formed further to the first holding portion 33 side than the center of the protecting portion 23 in the width direction W. The positioning of the wire through hole 23*b*, which is formed in the protecting portion 23, differs from that of the wire through hole 23*a*. Besides communicating with the second holding portion 36, the wire through hole 23*b* has the same configuration as the wire through hole 23*a*, and so no detailed description is provided.

Figure 7:
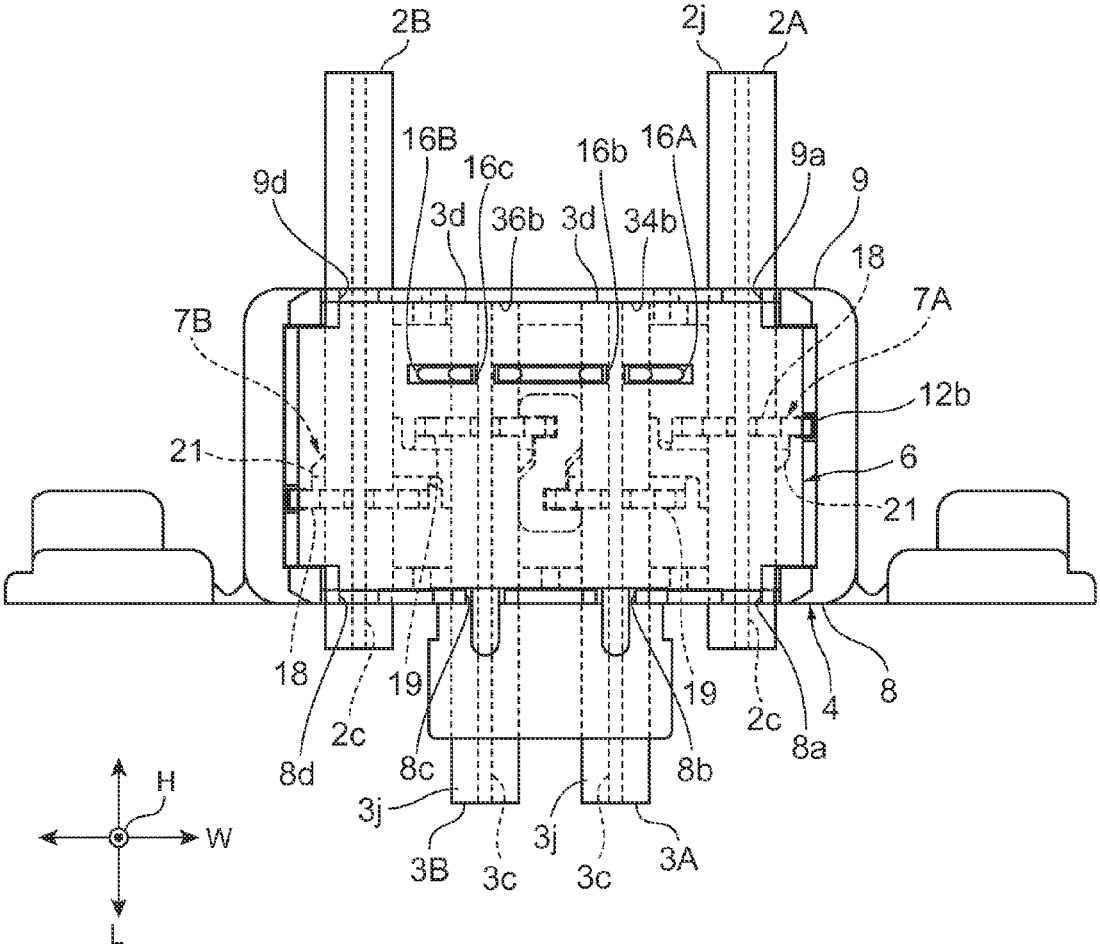
FIG. 7 is a plan view illustrating an arrangement of the wire holder holding a main wire and an extension wire in a body with a fixed contact.

FIG. 7 is a plan view illustrating an arrangement of the wire holder 6 holding the main wires 2A and 2B and the extension wires 3A and 3B in the body 4 having the fixed contacts 7A and 7B. When the wire holder 6 is disposed in the body 4, the main wire 2A is mechanically held due to the jacket 2*j* being positioned in the width direction W by the groove 8*a* of the front wall portion 8 of the body 4 and the groove 9*a* of the back wall portion 9, and the conducting wire 2*c* being sandwiched by the first sandwiching portion 18 of the contact 7A. The extension wire 3A is mechanically held due to the jacket 3*j* being positioned in the width direction W by the groove 8*b* and the groove 16*b* of an upward projecting portion 16A, and the conducting wire 3*c* being sandwiched by the second sandwiching portion 19 of the contact 7A. The first sandwiching portion 18 and the second sandwiching portion 19 are connected by the base portion 21. Accordingly, the conducting wire 2*c* of the main wire 2A is electrically connected to the conducting wire 3*c* of the extension wire 3A.

The extension wire 3B is mechanically held due to the jacket 3*j* being positioned in the width direction W by the groove 8*c* and the groove 16*c* of the upward projecting portion 16B, and the conducting wire 3*c* being sandwiched by the second sandwiching portion 19 of the contact 7B. Also, the main wire 2B is mechanically held due to the jacket 2*j* being positioned in the width direction W by the groove 8*d* and the groove 9*d* in the body 4, and the conducting wire 2*c* being sandwiched by the first sandwiching portion 18 of the contact 7B. The first sandwiching portion 18 and the second sandwiching portion 19 are connected by the base portion 21. Accordingly, the conducting wire 2*c* of the main wire 2B is electrically connected to the conducting wire 3*c* of the extension wire 3B. Note that the grooves 8*a* to 8*d*, the grooves 9*a* and 9*d*, and the grooves 16*b* and 16*c* function to suppress bending deformation abutting with the main wire 2A or the like when a bending force is acting on the main wires 2A and 2B or the extension wires 3A and 3B. With this configuration, bending forces acting on the contacts 7A and 7B can be suppressed and the fracturing of the main wire 2A and the like can be suppressed.

Next, a method for extending the main wires 2A and 2B through connection with the corresponding extension wires 3A and 3B using the above-described wire connector 1 will be described with reference to FIG. 8 to FIG. 13.

Figure 8:
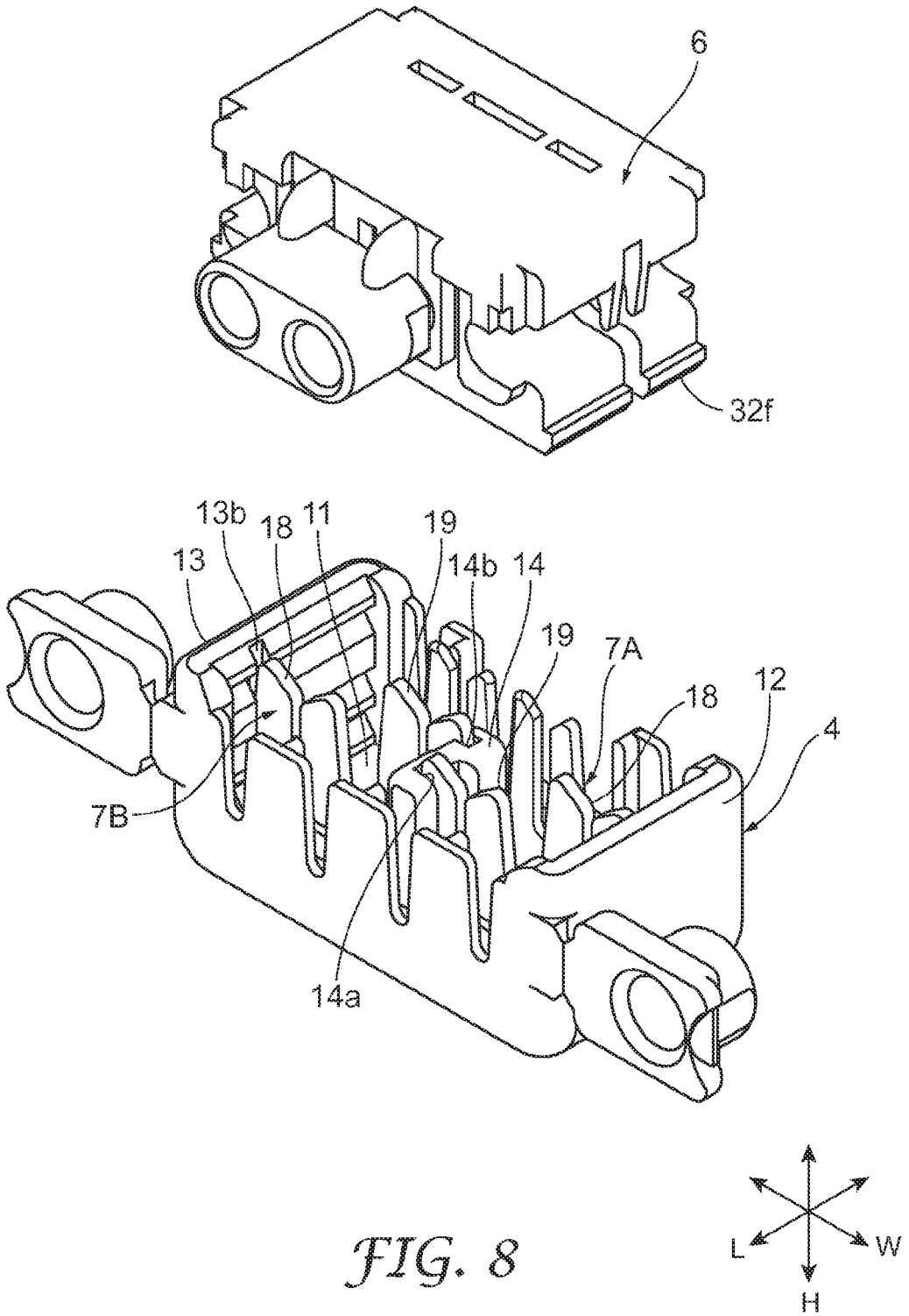
FIG. 8 is a diagram for describing a method for extending the main wire using the wire connector.

First, as illustrated in FIG. 8, the contacts 7A and 7B are disposed in the bottom portion 11 of the body 4. At this time, the first sandwiching portion 18 of the contact 7A is disposed in the groove 12*b* (see FIG. 7) formed inward of the sidewall 12 of the body 4 and the second sandwiching portion 19 is disposed in the groove 14*a* formed in the upward projecting portion 14 of the body 4. Similarly, the first sandwiching portion 18 of the contact 7B is disposed in the groove 13*b* formed inward of the sidewall 13 of the body 4 and the second sandwiching portion 19 is disposed in the groove 14*b* formed in the upward projecting portion 14 of the body 4.

Figure 9:
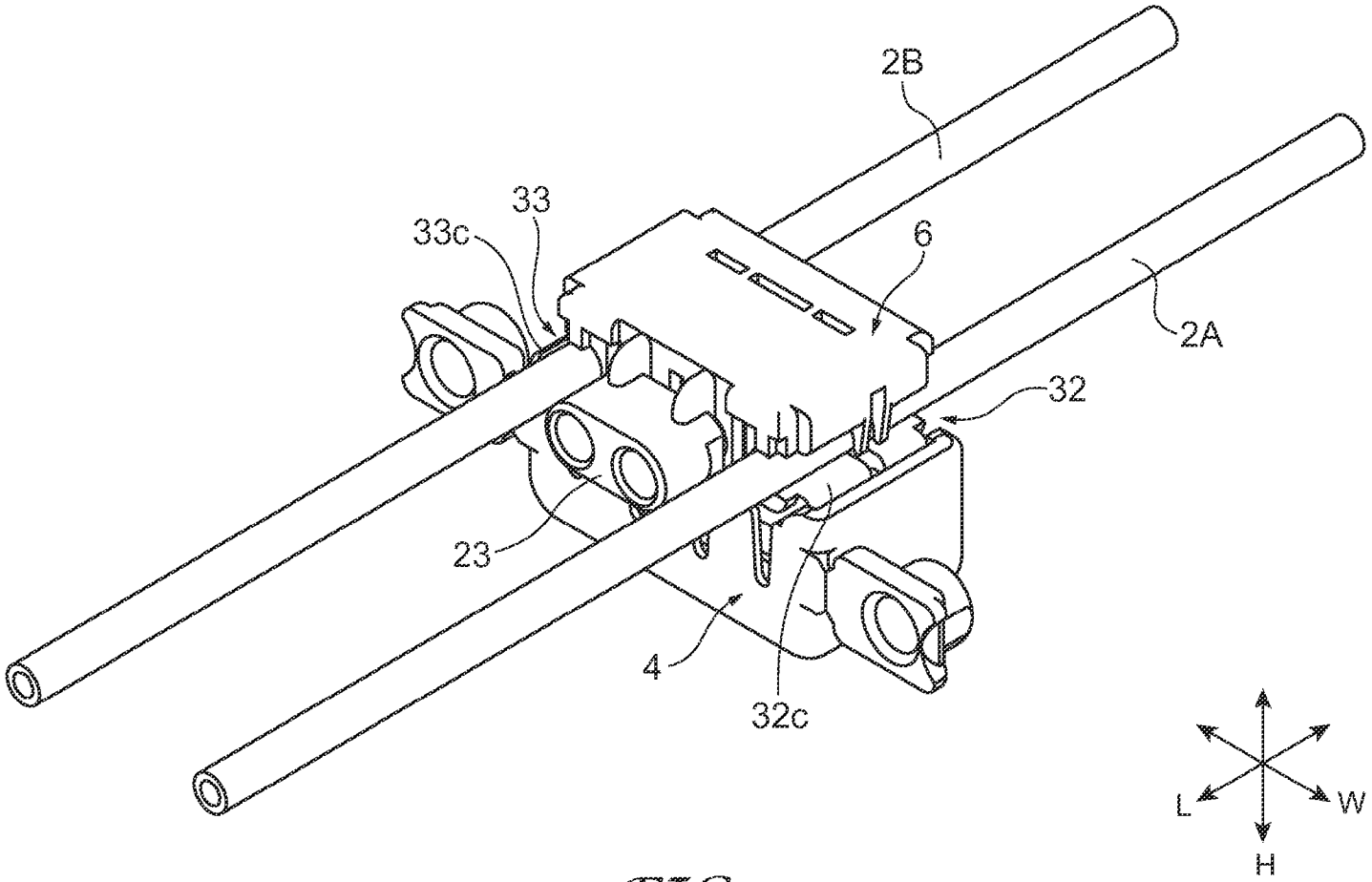
FIG. 9 is a diagram for describing a method for extending the main wire using the wire connector.
Figure 10:
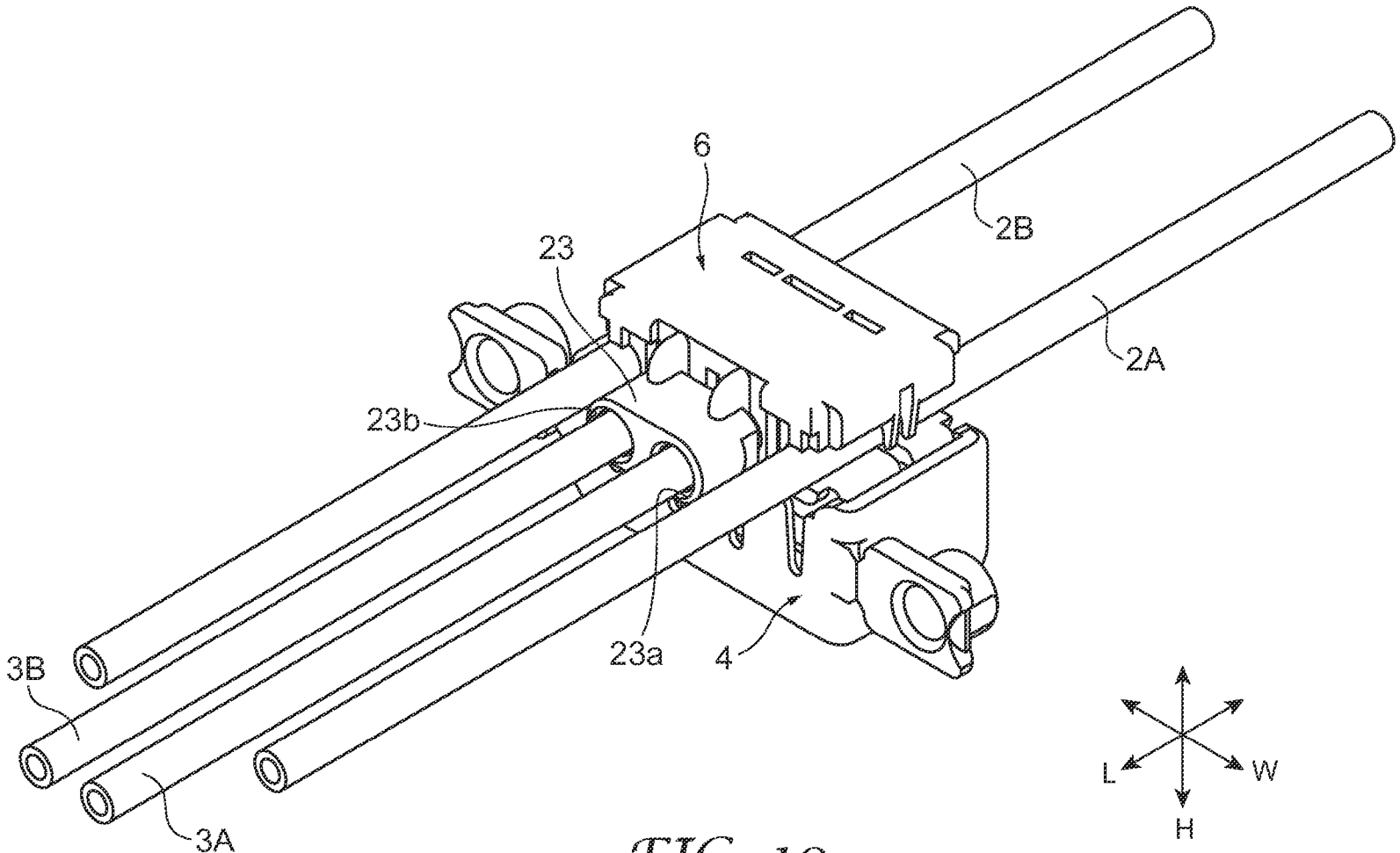
FIG. 10 is a diagram for describing a method for extending the main wire using the wire connector.

Next, as illustrated in FIG. 9, the main wire 2A is disposed in the first holding portion 32 by pushing the main wire 2A along the width direction W through the opening 32*c* in the first holding portion 32 of the wire holder 6. Similarly, the main wire 2B is disposed in the first holding portion 33 by pushing the main wire 2B along the width direction W through the opening 33*c* in the first holding portion 33 of the wire holder 6. At this time, it is not necessary for the main wires 2A and 2B to be cut to a predetermined length. Next, as illustrated in FIG. 10, the extension wires 3A and 3B are inserted into the wire holder 6 from the openings 23*a* and 23*b* in the protecting portion 23. At this time, the extension wires 3A and 3B are inserted into the wire holder 6 until the end portions 3*d* of the extension wires 3A and 3B reach the abutting portions 34*b* and 36*b* (see FIG. 7).

Next, as illustrated in FIG. 11, the wire holder 6 is inserted into the body 4 by pressing the wire holder 6 toward the bottom portion 11 (FIG. 2) side of the body 4. Pressing the wire holder 6 into the body 4 causes the first sandwiching portion 18 of the contacts 7A and 7B to penetrate into the jacket 2*j* of the main wires 2A and 2B and form an electrical connection with the conducting wire 2*c*, and the second sandwiching portion 19 to penetrate into the jacket 3*j* of the extension wires 3A and 3B and form an electrical connection with the conducting wire 3*c* as shown in FIG. 7. Further, the protruding portion 32*f* of the wire holder 6 engages with the protruding portions 12*a* and 13*a* formed inside the sidewalls 12 and 13 of the body 4 (FIG. 8), thus preventing the wire holder 6 from falling out of the body 4.

Figure 12:
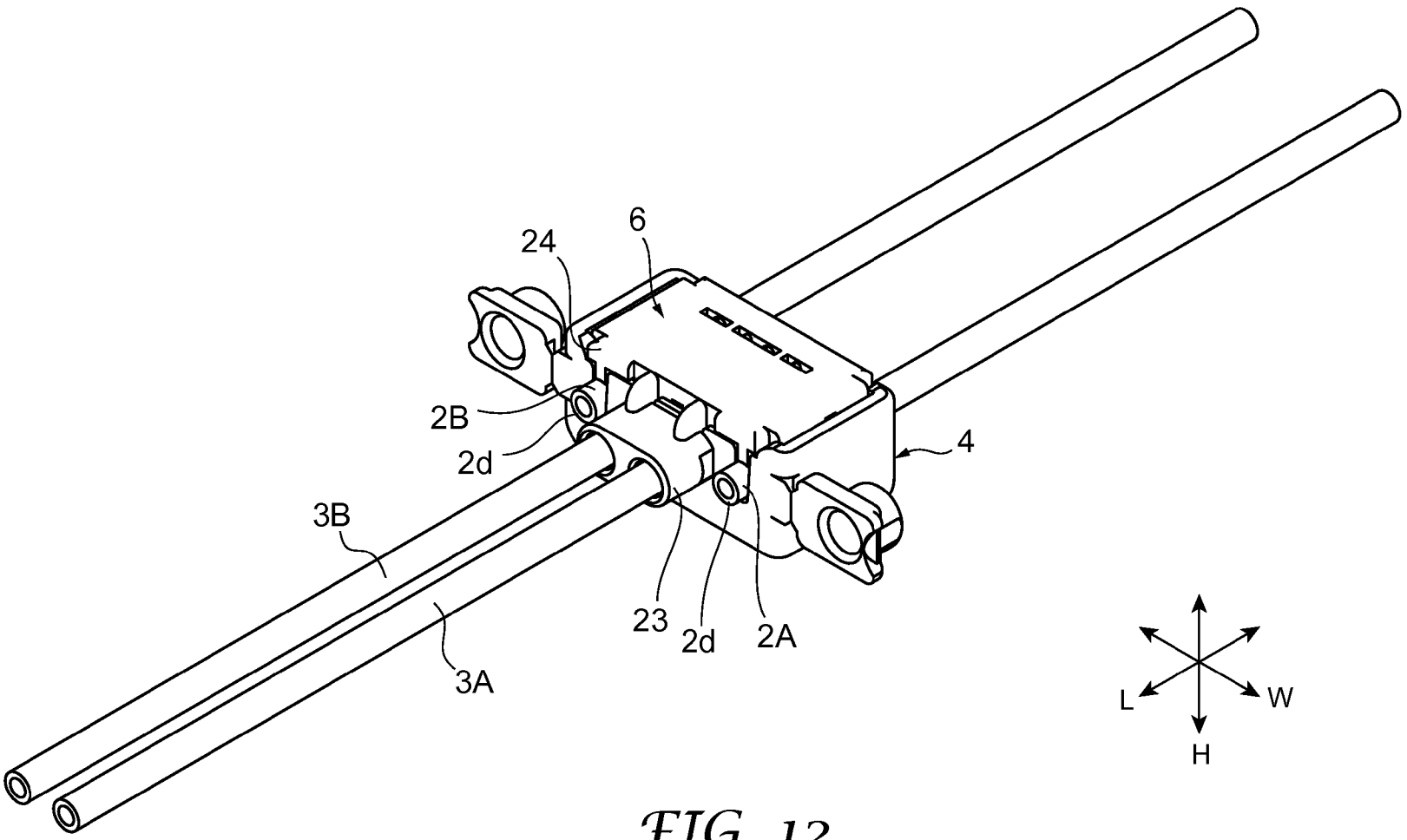
FIG. 12 is a diagram for describing a method for extending the main wire using the wire connector.

Next, as illustrated in FIG. 12, the main wires 2A and 2B are cut. At this time, the main wires 2A and 2B are cut at a position where the protruding length of the main wires 2A and 2B is less than the protruding length of the protecting portion 23 from the first end face 24. By cutting the main wires 2A and 2B at the above-described position, when the blades of the nippers (not illustrated) for cutting the main wires 2A and 2B are inserted deeply to the extension wires 3A and 3B, the blades of the nippers will abut with the protecting portion 23, allowing the operator to recognize that the blades of the nippers are at a position at which the extension wires 3A and 3B will be cut. Even if the blades of the nippers do not abut with the protecting portion 23 when the nippers are inserted, in the process of closing the blades of the nippers, the blades of the nippers will sandwich the protecting portion 23, and the operator will feel a greater resistance than when cutting the main wires 2A and 2B alone. Accordingly, the operator can recognize that the blades of the nippers are in position at which the extension wires 3A and 3B will be cut.

Note that if the main wires 2A and 2B are not cut, the main wires 2A and 2B may be branched into the main wires 2A and 2B and the extension wires 3A and 3B.

Figure 13:
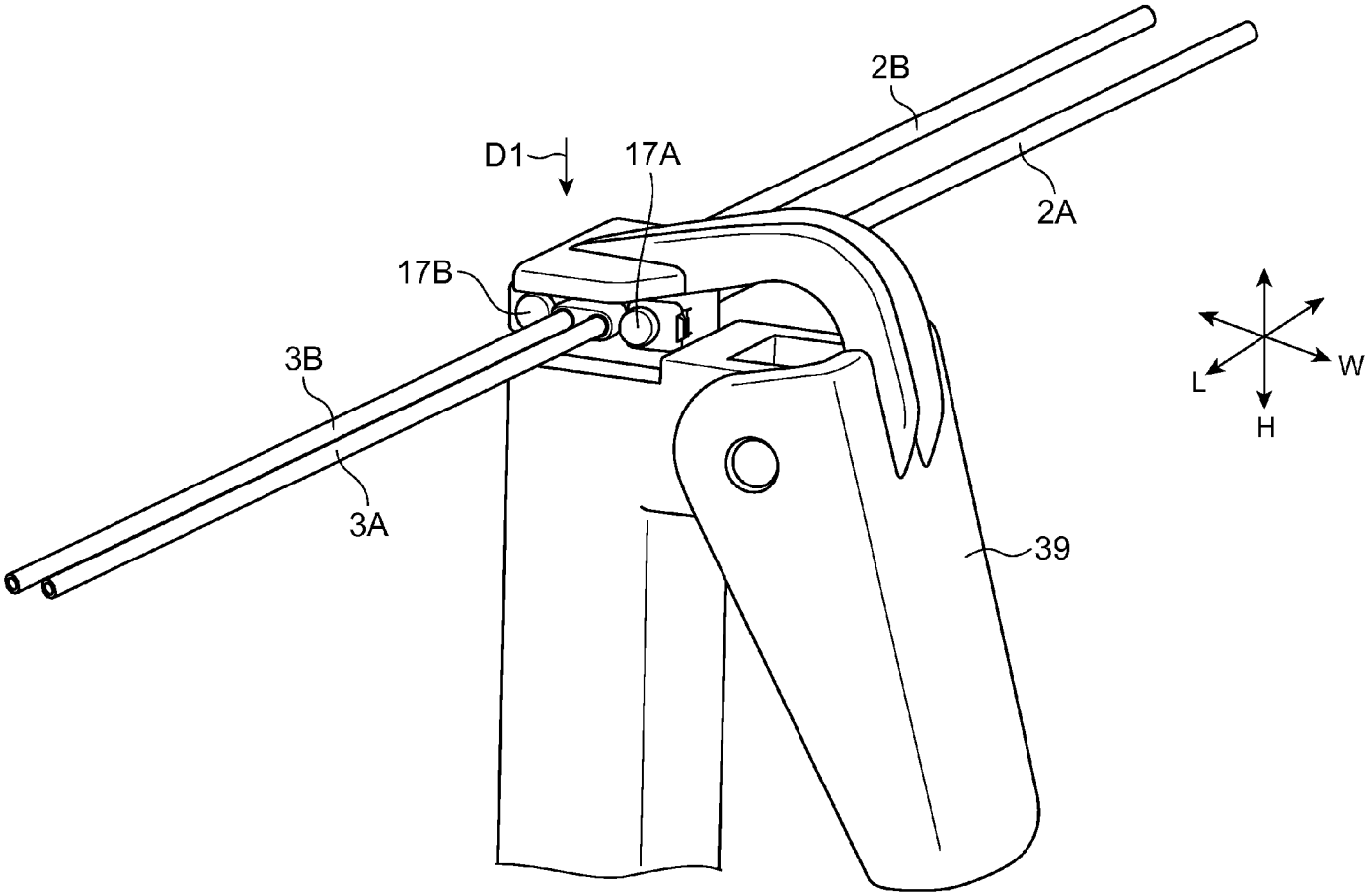
FIG. 13 is a diagram for describing a method for extending the main wire using the wire connector.

Next, as illustrated in FIG. 13, the covers 17A and 17B formed as part of the body 4 are placed on the end portions 2*d* (see FIG. 12) of the main wires 2A and 2B. Then, with a predetermined tool 39, force is applied in a direction D1 to pressing the wire holder 6 onto the body 4. As a result of the above method, the arrangement enters the state illustrated in FIG. 1 and the extension operation on the main wires 2A and 2B using the wire connector 1 is completed.

Next, the effects and advantages of the wire connector 1 according to this embodiment will be described.

When the main wires 2A and 2B pulled through the opening 32*a* of the first holding portions 32 and 33 are not cut, the wire connector 1 allows the main wires 2A and 2B to be branched into the main wires 2A and 2B and the extension wires 3A and 3B. On the other hand, when the main wires 2A and 2B are cut, the main wires 2A and 2B can be extended through connection with the extension wires 3A and 3B. Accordingly, the wire connector 1 of this embodiment can be used for both wire branching and wire extension. Thus, according to the wire connector 1 of the present invention, there is no need to prepare wire connectors only for wire branching and wire connectors only for wire extension prior to wire connection operation, and no need to select the appropriate connector for each type of connection during the wire connection operation. Hence, the wire connection operation can be performed efficiently.

Further, the extension wires 3A and 3B are protected by the protecting portion 23. As a result, in the case of cutting the main wires 2A and 2B and in the case of cutting the main wires 2A and 2B and the protecting portion 23 simultaneously, the operator will feel that the resistance is different and can recognize that the blades of the nippers are at a position at which the extension wires 3A and 3B will be cut. Accordingly, cutting of the extension wires 3A and 3B by mistake in cutting operations on the main wires 2A and 2B can be suppressed.

Moreover, with the wire connector 1 of this embodiment, the extension wires 3A and 3B that are not to be cut are covered by the protecting portion 23, and so the operator is provided with visual encouragement to take care not to cut the extension wires 3A and 3B.

In the wire connector 1 of this embodiment, the protecting portion 23 is formed around the entire circumference of the extension wires 3A and 3B. Thus, cutting of the extension wires 3A and 3B by mistake in cutting operations on the main wires 2A and 2B can be further suppressed.

The wire connector 1 of this embodiment includes a configuration in which the main wire 2A is connected to the extension wire 3A and a configuration in which the main wire 2B is connected to the extension wire 3B. It is therefore possible to branch or extend two sets of main wire and extension wire using a single wire connector 1.

In the wire connector 1 of this embodiment, the second holding portions 34 and 36 that hold the extension wires 3A and 3B are sandwiched between the first holding portions 32 and 33 that hold the main wires 2A and 2B. According to this configuration, the main wires 2A and 2B are disposed to the outer side of the extension wires 3A and 3B. With such an arrangement, the nippers can be inserted in a direction from the main wire 2A toward the extension wire 3A or a direction from the main wire 2B toward the extension wire 3B. Hence, the main wires 2A and 2B alone can be cut easily, without cutting the extension wires 3A and 3B. Thus, it is easy to cut the main wires 2A and 2B alone.

In the wire connector 1 of this embodiment, the body 4 includes the covers 17A and 17B for covering the opening 32*a* of the first holding portions 32 and 33. As a result, the cross section of the main wires 2A and 2B where the conducting wire 2*c* is exposed can be protected.

Figure 14:
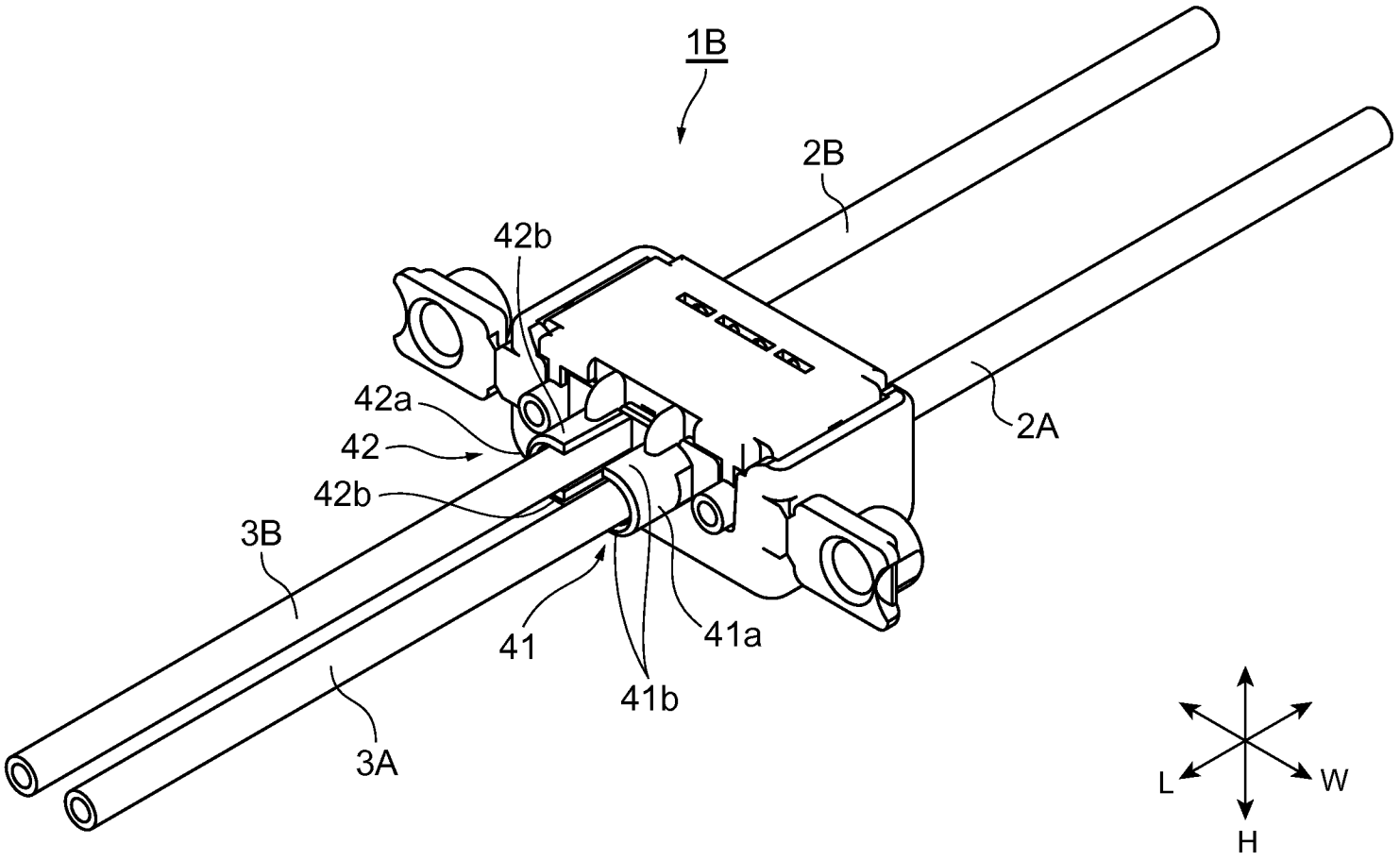
FIG. 14 is a perspective view for describing a wire connector according to a second embodiment.

FIG. 14 is a perspective view illustrating a wire connector 1B according to a second embodiment. The wire connector 1B includes protecting portions 41 and 42 having a configuration that differs from the protecting portion 23 of the wire connector 1 according to a first embodiment. Other parts of the configuration are similar to those of the wire connector 1 of the first embodiment. The protecting portion 41 has an arc-form that includes a protruding portion 41 a formed between the main wire 2A and the extension wire 3A, and a protruding portion 41*b* that sandwiches the extension wire 3A along the thickness direction H. In other words, the protecting portion 41 is formed at a peripheral edge portion further to the main wire 2A side than a line L1 passing through the center of the extension wire 3A along the thickness direction H (see FIG. 6). The protecting portion 42 has an arc-form that includes a protruding portion 42*a* formed between the main wire 2B and the extension wire 3B, and a protruding portion 42*b* that sandwiches the extension wire 3B along the thickness direction H. The protecting portions 41 and 42 include the protruding portions 41*a*, 41*b*, 42*a* and 42*b* formed in the regions S1 to S5 illustrated in FIG. 6, and so the same effects as the protecting portion 23 of the first embodiment can be achieved.

Figure 15:
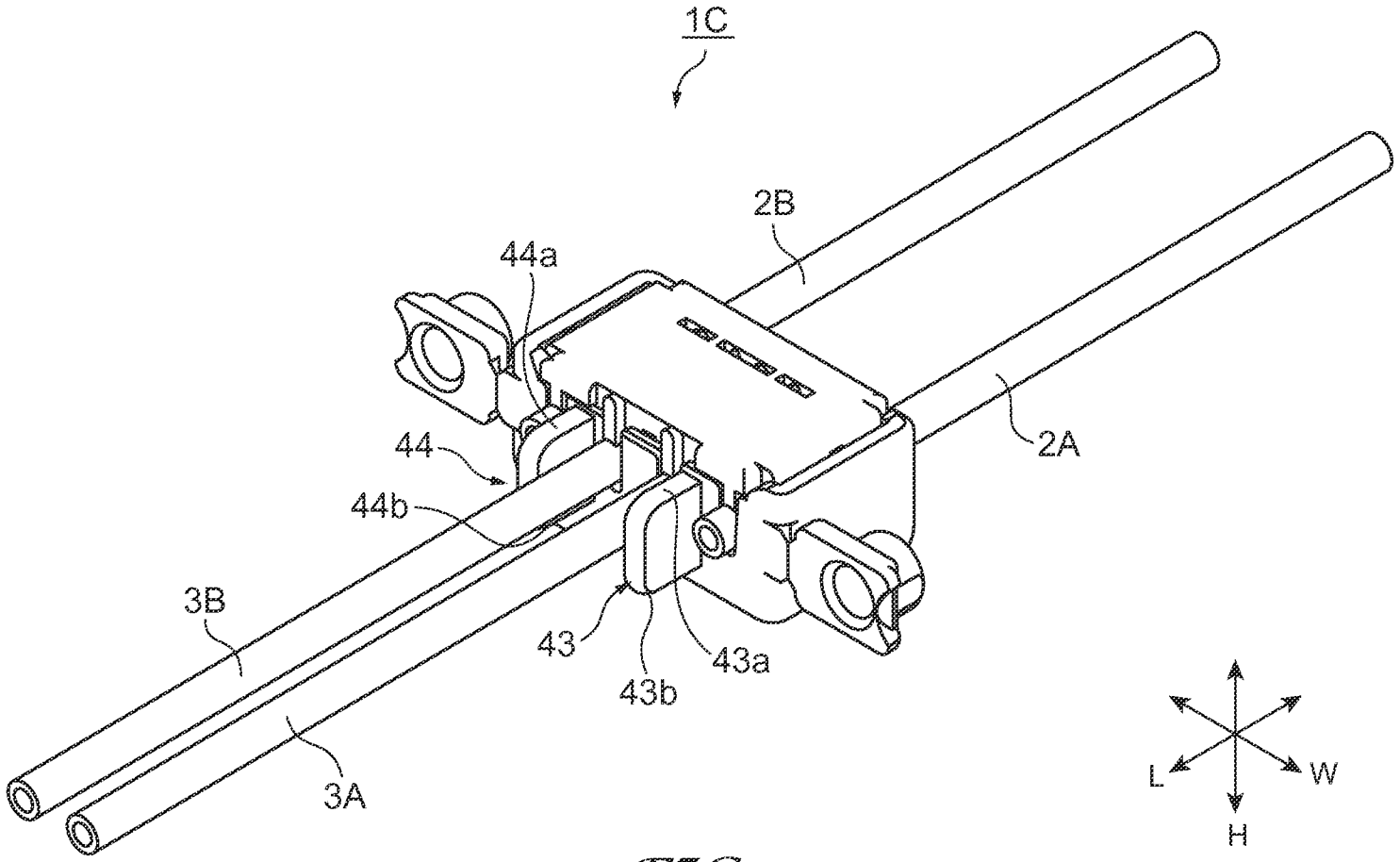
FIG. 15 is a perspective view for describing a wire connector according to a third embodiment.

FIG. 15 is a perspective view illustrating a wire connector 1C according to a third embodiment. The wire connector 1C includes protecting portions 43 and 44 having a configuration that differs from the protecting portion 23 of the wire connector 1 according to the first embodiment. Other parts of the configuration are similar to those of the wire connector 1 of the first embodiment. The protecting portion 43 is a protruding portion formed between the main wire 2A and the extension wire 3A. The protecting portion 43 projects in the predetermined direction L and extends along the thickness direction H. A top edge 43*a* of the protecting portion 43 is formed further to an upper side than the main wire 2A and the extension wire 3A. A bottom edge 43*b* of the protecting portion 43 is formed further to a lower side than the main wire 2A and the extension wire 3A. The protecting portion 44 is a protruding portion formed between the main wire 2B and the extension wire 3B. The protecting portion 44 projects in the predetermined direction L and extends along the thickness direction H. A top edge 44*a* of the protecting portion 44 is formed further to an upper side than the main wire 2B and the extension wire 3B. A bottom edge 44*b* of the protecting portion 44 is formed further to a lower side than the main wire 2A and the extension wire 3A. The protecting portions 43 and 44 include the protruding portions formed in the regions S1 to S5 illustrated in FIG. 6, and so the same effects as the protecting portion 23 of the first embodiment can be achieved.

Figure 16:
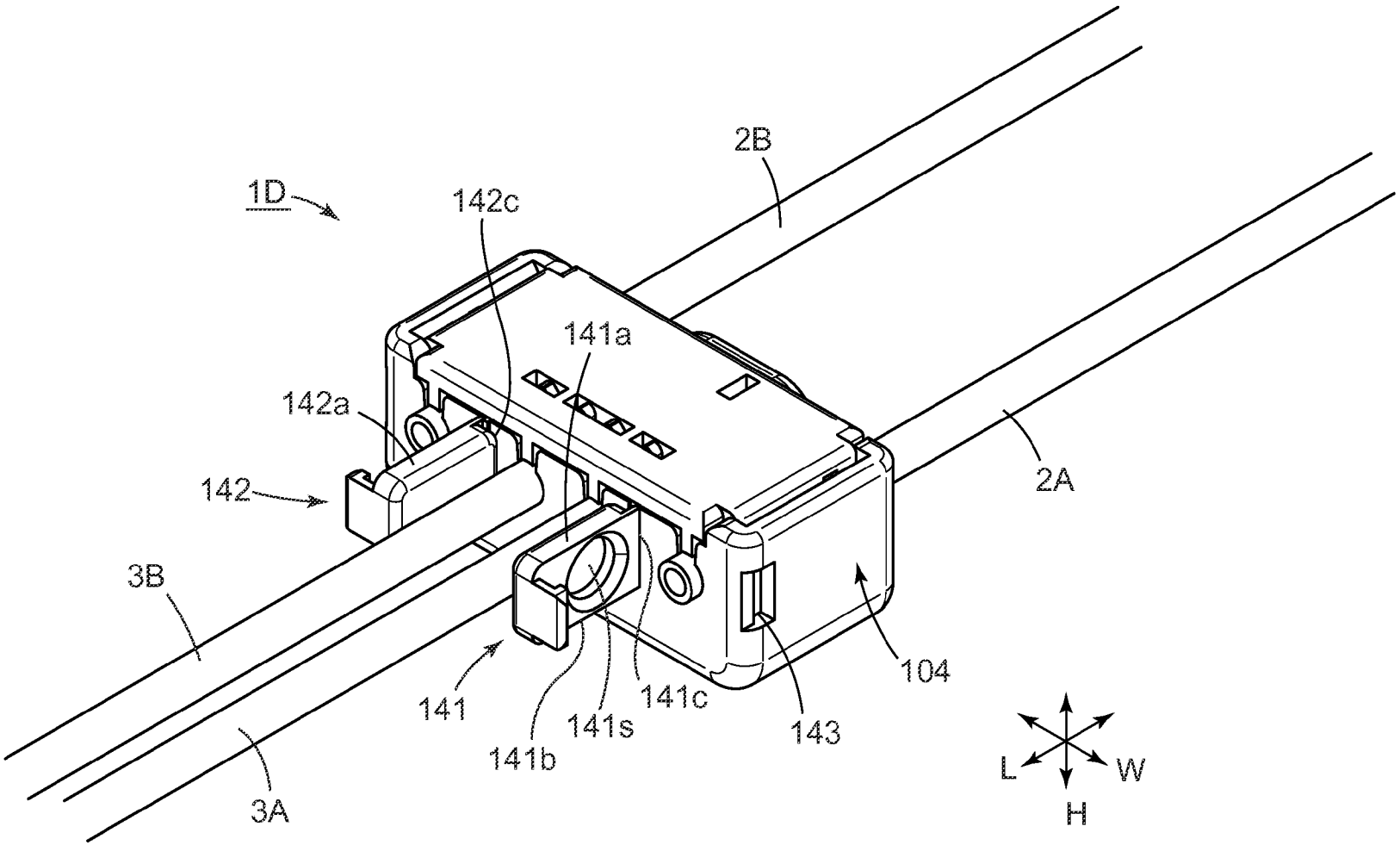
FIG. 16 is a perspective view for describing a wire connector according to a fourth embodiment.

FIG. 16 is a perspective view illustrating a wire connector 1D according to a fourth embodiment. The wire connector 1D includes protecting portions 141 and 142 having a configuration that differs from the protecting portion 23 of the wire connector 1 according to the first embodiment. Other parts of the configuration are similar to those of the wire connector 1 of the first embodiment except in that the cover 17A provided at the corner portion 4*a* is replaced by an engaging portion 143 and the cover 17B provided at the corner portion 4*b* is replaced by an engaging portion (not illustrated). The protecting portion 141 is a protruding portion formed between the main wire 2A and the extension wire 3A, and includes a cover portion 141*s* that covers the end portion of the main wire 2A and a connecting portion 141*c* that connects the protecting portion 141 to a body 104. After the main wire 2A is cut, the connecting portion 141*c* is bent to cause the protecting portion 141 to engage with the engaging portion 143, and functions as a cover to protect the end portion of the main wire 2A. The protecting portion 141 projects in the predetermined direction L and extends along the thickness direction H. A top edge 141*a* of the protecting portion 141 is formed further to an upper side than the main wire 2A and the extension wire 3A. A bottom edge 141*b* of the protecting portion 141 is formed further to a lower side than the main wire 2A and the extension wire 3A. The protecting portion 142 is a protruding portion formed between the main wire 2B and the extension wire 3B, has a form symmetrical to the protecting portion 141, and includes a cover portion (not illustrated) that covers the end portion of the main wire 2B and a connecting portion 142*c* that connects the protecting portion 142 to the body 104. After the main wire 2B is cut, the connecting portion 142*c* is bent to cause the protecting portion 142 to engage with the engaging portion (not illustrated), and functions as a cover to protect the end portion of the main wire 2B. The protecting portion 142 projects in the predetermined direction L and extends along the thickness direction H. A top edge 142*a* of the protecting portion 142 is formed further to an upper side than the main wire 2B and the extension wire 3B. A bottom edge (not illustrated) of the protecting portion 142 is formed further to a lower side than the main wire 2B and the extension wire 3B. The protecting portions 141 and 142 include the protruding portions formed in the regions S1 to S5 illustrated in FIG. 6, and so the same effects as the protecting portion 23 of the first embodiment can be achieved.

The present invention is not limited to the above described embodiments, but includes modifications which do not depart from the spirit of the present invention.

Figure 17B:
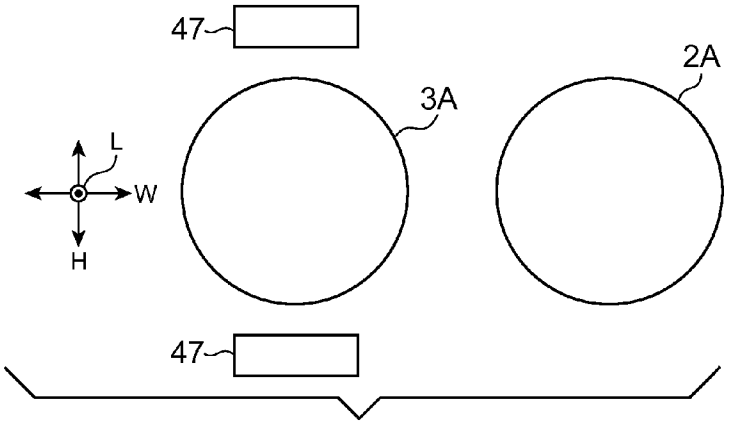
FIGS. 17*a-c* are views for describing alternative protecting portions usable with the exemplary wire connector.
Figure 17A:
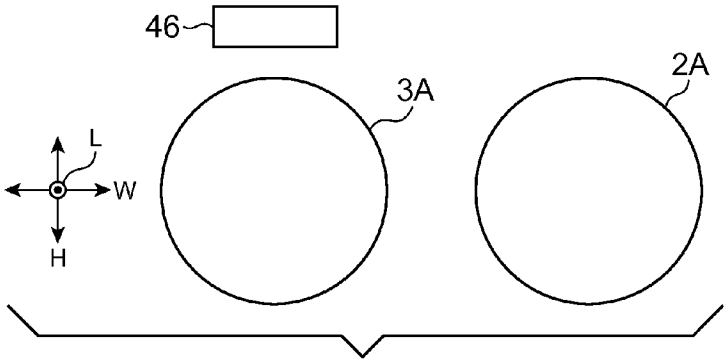
Figure 17C:
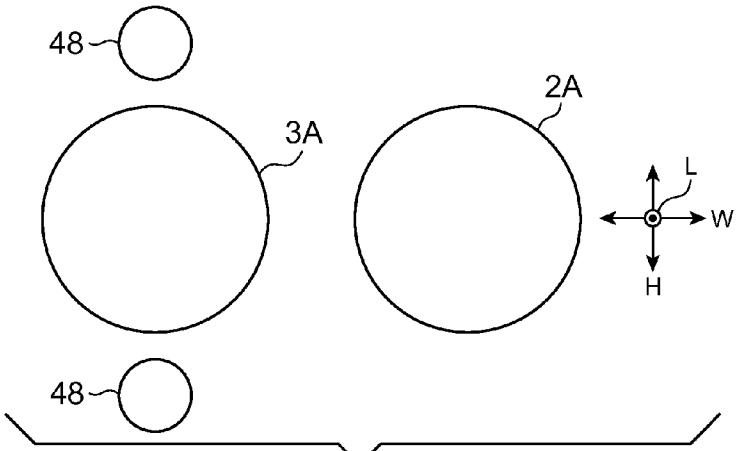

The protecting portion included in the wire connector is not limited to the protecting portions 23 and 41 to 44 illustrated in the above described first to third embodiments. It is sufficient that protecting portion of the present invention is formed in the region S2 (see FIG. 6) that constitutes at least a portion of the peripheral edge portion of the openings 34*a* and 36*a* of the second holding portions 34 and 36. FIG. 17 is a view illustrating the alternative protecting portion of first to third modified examples. For example, in the first modified example illustrated in FIG. 17A, a protecting portion 46 is a rectangular protruding portion formed only at an upper portion of the extension wire 3A when viewed in the predetermined direction L. In the second modified example illustrated in FIG. 17B, a protecting portion 47 is a rectangular protruding portion formed so as to sandwich the extension wire 3A along the thickness direction H on the top and bottom sides of the extension wire 3A when viewed in the predetermined direction L. In the third modified example illustrated in FIG. 17C, a protecting portion 48 is a cylindrical protruding portion formed so as to sandwich the extension wire 3A along the thickness direction H when viewed in the predetermined direction L.

In the first to third embodiments, the wire holder 6 of the wire connectors 1, 1B and 1C include the first and second wire holding portions 25A and 25B. However, there may only be a single wire connecting portion included in the wire holder.

What is claimed is:

1. A wire connector comprising: a wire holder holding at least a first wire and a second wire;

a contact electrically connecting the first wire and the second wire; and a body fixing the contact and holding the wire holder, wherein the wire holder includes:

a first end face formed on a first end side in a predetermined direction;

a second end face formed on a second end side in the predetermined direction; and a wire holding portion holding the first wire and the second wire in a state of the first wire and the second wire extending in the predetermined direction and being mutually adjacent in a direction orthogonal to the predetermined direction, the wire holding portion includes:

a first holding portion holding the first wire; and a second holding portion formed at a position separated from the first holding portion in a direction orthogonal to the predetermined direction and holding the second wire, in the first holding portion, an opening enabling the first wire to be pulled through is formed in the first end face and the second end face, in the second holding portion, an opening enabling the second wire to be pulled through is formed in the first end face and an abutting portion for abutting an end portion of the second wire is formed on the second end face side, and on the first end face, in at least a portion of a circumferential edge of the opening in the second holding portion, a protecting portion that projects from the first end face and protects the second wire.

2. The wire connector according to claim 1, wherein the protecting portion has a cylindrical form surrounding the second wire and includes a wire through hole that communicates with the second holding portion and through which the second wire is inserted.

3. The wire connector according to claim 1, further comprising a second wire holding portion that is not the first wire holding portion, wherein the second holding portion of the first wire holding portion and the second holding portion of the second wire holding portion are disposed between the first holding portion of the first wire holding portion and the first holding portion of the second wire holding portion.

4. The wire connector according to claim 1, wherein the body includes a cover that covers the opening of the first holding portion.

5. The wire connector according to claim 2, further comprising a second wire holding portion that is not the first wire holding portion, wherein the second holding portion of the first wire holding portion and the second holding portion of the second wire holding portion are disposed between the first holding portion of the first wire holding portion and the first holding portion of the second wire holding portion.

6. The wire connector according to claim 2, wherein the body includes a cover that covers the opening of the first holding portion.

7. The wire connector according to claim 3, wherein the body includes a cover that covers the opening of the first holding portion.

8. The wire connector according to claim 5, wherein the body includes a cover that covers the opening of the first holding portion.

* * * * *